US012780502B2

(12) United States Patent
Davis et al.

(10) Patent No.: US 12,780,502 B2
(45) Date of Patent: Nov. 3, 2026

(54) DISPENSER FOR PRODUCTS IN A FLEXIBLE TUBE

(71) Applicant: DAVIS FOOD, LLC, Evansville, IN (US)

(72) Inventors: Jon Clay Davis, Evansville, IN (US); Robert Davignon, Terre Haute, IN (US); Ashwin Ganeshan, San Jose, CA (US); Steve Escobar, San Jose, CA (US)

( * ) Notice: Subject to any disclaimer, the term of this patent is extended or adjusted under 35 U.S.C. 154(b) by 257 days.

(21) Appl. No.: 18/585,730

(22) Filed: Feb. 23, 2024

(65) Prior Publication Data

US 2024/0294306 A1 Sep. 5, 2024

Related U.S. Application Data

(60) Provisional application No. 63/488,357, filed on Mar. 3, 2023.

(51) Int. Cl.

| | |
|---|---|
| ***B65D 35/28*** | (2006.01) |
| ***B65D 17/42*** | (2006.01) |
| ***B65D 77/06*** | (2006.01) |

(52) U.S. Cl.

CPC ..... *B65D 35/28* (2013.01); *B65D 17/42* (2018.01); *B65D 77/06* (2013.01); *B65D 77/067* (2013.01); *B65D 2517/004* (2013.01)

(58) Field of Classification Search

CPC ..... B65D 35/28; B65D 17/42; B65D 77/06; B65D 2517/004; B65D 77/067

See application file for complete search history.

(56) References Cited

U.S. PATENT DOCUMENTS

| | | | | |
|---|---|---|---|---|
| 4,418,840 | A | 12/1983 | Gardner, Sr. | |
| 4,896,794 | A * | 1/1990 | Banks | B65D 83/771 141/3 |
| 5,060,826 | A * | 10/1991 | Coleman | B67D 1/0462 222/105 |
| 5,096,092 | A * | 3/1992 | Devine | B67D 1/0462 222/105 |
| 5,238,150 | A * | 8/1993 | Williams | B65D 83/60 222/386 |
| 5,884,812 | A | 3/1999 | Stawowski | |
| 5,940,880 | A * | 8/1999 | Phillips | A42B 3/048 222/401 |
| 6,662,971 | B1 | 12/2003 | Nguyen et al. | |

(Continued)

FOREIGN PATENT DOCUMENTS

| | | |
|---|---|---|
| CN | 105083660 | 11/2015 |
| CN | 105857796 | 8/2016 |
| JP | 2009173333 | 8/2009 |

*Primary Examiner* — Frederick C Nicolas

(74) *Attorney, Agent, or Firm* — Woodard, Emhardt, Henry, Reeves & Wagner, LLP; William A. McKenna

(57) ABSTRACT

A dispenser for dispensing a product from a flexible tube includes a shell and a dispensing apparatus that is positioned within a dispenser opening defined within the shell. A mouthpiece is attached to the shell and is in fluid communication with the dispenser opening and with the flexible tube when the flexible tube is positioned within the dispenser opening. Operation of the dispensing apparatus causes the product within the flexible tube to be dispensed from the flexible tube and expelled from the dispenser through the mouthpiece.

18 Claims, 24 Drawing Sheets

(56) References Cited

U.S. PATENT DOCUMENTS 6,908,015 B2 * 6/2005 Choi ..... A45F 3/20 222/529
7,073,688 B2 * 7/2006 Choi ..... F16L 37/0841 222/105
7,377,403 B2 5/2008 Gorrie
8,083,105 B2 * 12/2011 Reichert ..... A45F 3/20 383/906
8,166,969 B2 * 5/2012 Hall ..... A45F 3/20 604/262
8,201,711 B2 * 6/2012 Tsai ..... F15D 1/02 222/144.5
8,276,785 B1 * 10/2012 Wheatley ..... A45F 3/20 222/107
8,333,290 B2 * 12/2012 Kuwahara ..... B65D 51/18 220/255
8,376,988 B2 * 2/2013 Perovitch ..... A61J 7/0046 604/88
8,408,426 B2 * 4/2013 Bakhos ..... B65D 81/245 222/105
8,505,783 B2 * 8/2013 Gill ..... A45F 3/20 215/388
9,505,600 B2 11/2016 Vulpitta et al.
10,124,921 B2 11/2018 Barron
10,450,108 B2 10/2019 Vaughan et al.
11,192,674 B2 12/2021 Nehus et al.
2006/0043107 A1 3/2006 Rodrigues
2007/0029349 A1 2/2007 Glen
2007/0119875 A1 * 5/2007 Ehret ..... B67D 1/045 222/401
2008/0029561 A1 * 2/2008 Reichert ..... A45F 3/20 224/148.2
2012/0104020 A1 * 5/2012 Cur ..... B67D 1/0001 222/105
2012/0111894 A1 * 5/2012 Bakhos ..... B67D 7/0244 222/386.5
2013/0193164 A1 * 8/2013 Tom ..... B65D 25/16 222/105
2013/0214009 A1 * 8/2013 Bakhos ..... B65D 83/771 222/386.5
2014/0151319 A1 * 6/2014 DeFelice ..... A47G 19/2266 215/11.5

* cited by examiner

DISPENSER FOR PRODUCTS IN A FLEXIBLE TUBE

CROSS-REFERENCE TO RELATED APPLICATION

This application claims the benefit of U.S. Provisional Application No. 63/488,357 filed Mar. 3, 2023, which is hereby incorporated by reference to the extent not inconsistent.

BACKGROUND

Squeezable snacks may come in portable packaging that allows the snack to be transported and consumed on the go. Often, these snacks are designed for children, and the packaging of these squeezable snacks may be difficult to open and may be messy to use.

Thus, there is a need for improvement in this field.

SUMMARY

Certain embodiments include a dispenser for dispensing products contained in a flexible tube. The dispenser may include a shell and a dispenser opening may be defined within an interior of the shell. An inflatable bladder may be positioned within the dispenser opening. In some instances, the inflatable bladder may be attached to an inner surface of the shell. In some examples, the inflatable bladder has a differing thickness along its longest length and in others the dispenser opening has a differing thickness.

A dispenser cap may be attachable to the shell. The dispenser cap may define a mouthpiece opening in communication with the dispenser opening. A mouthpiece assembly may include a tapered end and define a mouthpiece channel extending through a length of the mouthpiece assembly between a top mouthpiece opening and a bottom mouthpiece opening. In some examples, the tapered end of the mouthpiece assembly can be positioned within the dispenser opening when the mouthpiece assembly is at least partially inserted into the mouthpiece opening. The contents of the flexible tube may be expelled into the mouthpiece channel and out of the top mouthpiece opening when the inflatable bladder is inflated within the dispenser opening.

In some instances, the mouthpiece assembly may include a piercer assembly that is positioned within the dispenser cap and a mouthpiece assembly may include a mouthpiece insert that is insertable into the mouthpiece opening. The piercer assembly may include a piercer sheath and a piercer tool positioned within a piercer sheath recess defined by the piercer sheath. The tapered end of the mouthpiece assembly may be positioned at an end of said piercer tool. The piercer tool may define a piercer tool channel, and the mouthpiece insert may define a mouthpiece insert channel. The mouthpiece channel may be formed by the piercer tool channel and the mouthpiece insert channel when the mouthpiece insert is positioned in the mouthpiece opening.

The piercer tool may be configured to be moved between an undeployed position and a deployed position. A larger portion of said piercer tool may be positioned within the dispenser opening when the piercer tool is in the deployed position compared to the undeployed position. A piercer spring may be positioned within the piercer sheath, and the pierce spring may bias the piercer tool into the undeployed position.

In some examples, the dispenser may include a motor that is operable to inflate the inflatable bladder. The dispenser may also include an inflation actuator. Actuation of the inflation actuator may operate the motor to inflate the inflatable bladder. The dispenser may also include a pressure release valve and operation of the pressure release valve may deflate the inflatable bladder. In some examples, a control housing may be positioned on an outer surface of the shell and in some instances may be detachable from the shell. The control housing may include the motor, the inflation actuator, and the pressure release valve.

In some examples, the dispenser may include a sealing mechanism configured to deflate the inflatable bladder when the dispenser cap is in an open position, hinged away from the shell. The sealing mechanism may include a plug and a nozzle including a plug seat. The plug may seal the nozzle when the plug is positioned in the plug seat. The nozzle may allow air to be removed from the inflatable bladder when the plug is removed from the plug seat. The dispenser cap may include a dispenser cap finger that is configured to contact the plug when the dispenser cap is in a closed position to move the plug into the plug seat. The dispenser cap finger may not be in contact with said plug when said dispenser cap is in the open position, and said plug is removed from said plug seat when said dispenser cap finger is not in contact with said plug.

In some instances, the shell may be formed by a base housing and a slider housing attachable to the base housing. The dispenser opening may be defined between the slider housing and the base housing. The dispenser cap can be slidably attachable to a slider housing cap of the slider housing. In some examples, the dispenser cap may include a track defining a gap and the gap may receive a portion of the slider housing cap when the dispenser cap is attached to the shell.

A method of dispensing a product from a flexible tube may include inserting at least a portion of a flexible tube into a dispenser opening defined by a shell. An inflatable bladder may be positioned within the dispenser opening. A cap may be coupled to the shell, wherein the cap may include a mouthpiece opening defined through the cap, and the mouthpiece opening may be in communication with the dispenser opening when the cap is attached to the shell. At least a portion of a mouthpiece assembly may be inserted through the mouthpiece opening and into the dispenser opening so that a bottom end of the mouthpiece assembly pierces the flexible tube. The inflatable bladder may be inflated within the dispenser opening so that the inflatable bladder applies a force on the flexible tube. The force applied on the flexible tube due to inflation of the inflatable bladder may causes product from within the flexible tube to be expelled from the mouthpiece assembly.

In some instances, once the contents of the flexible tube have been expelled from the flexible tube, the inflatable bladder may then be deflated. The cap may then be decoupled from the shell, and the flexible tube can be removed from the dispenser opening.

In some examples, the shell may include a slider housing and a base housing. The slider housing may be slidably attached to the base housing to form the dispenser opening between the slider housing and the base housing.

In another embodiment, a dispenser may include a shell and a dispensing apparatus positioned within a dispenser opening defined within the shell. A mouthpiece may be attached to the shell, and the mouthpiece may be in fluid communication with the dispenser opening. When a flexible tube is positioned within the dispenser opening, operation of the dispensing apparatus is configured to expel contents of the flexible tube from within the flexible tube within dispenser opening and through the mouthpiece.

In some instances, the dispensing apparatus may be an inflatable bladder. The inflatable bladder may be attached to an inner surface of the shell. A motor may be operable to inflate the inflatable bladder.

In other instances, the dispensing apparatus may be a roller, and the roller may be translatable within the dispenser opening. The dispenser may include one or more actuators that can be positioned on an exterior surface of the shell. The one or more actuators may be operable to control a direction of movement of the roller. An indicator display may be positioned on an exterior surface of the shell, and the indicator display may be configured to indicate a position of the roller within the dispenser opening.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
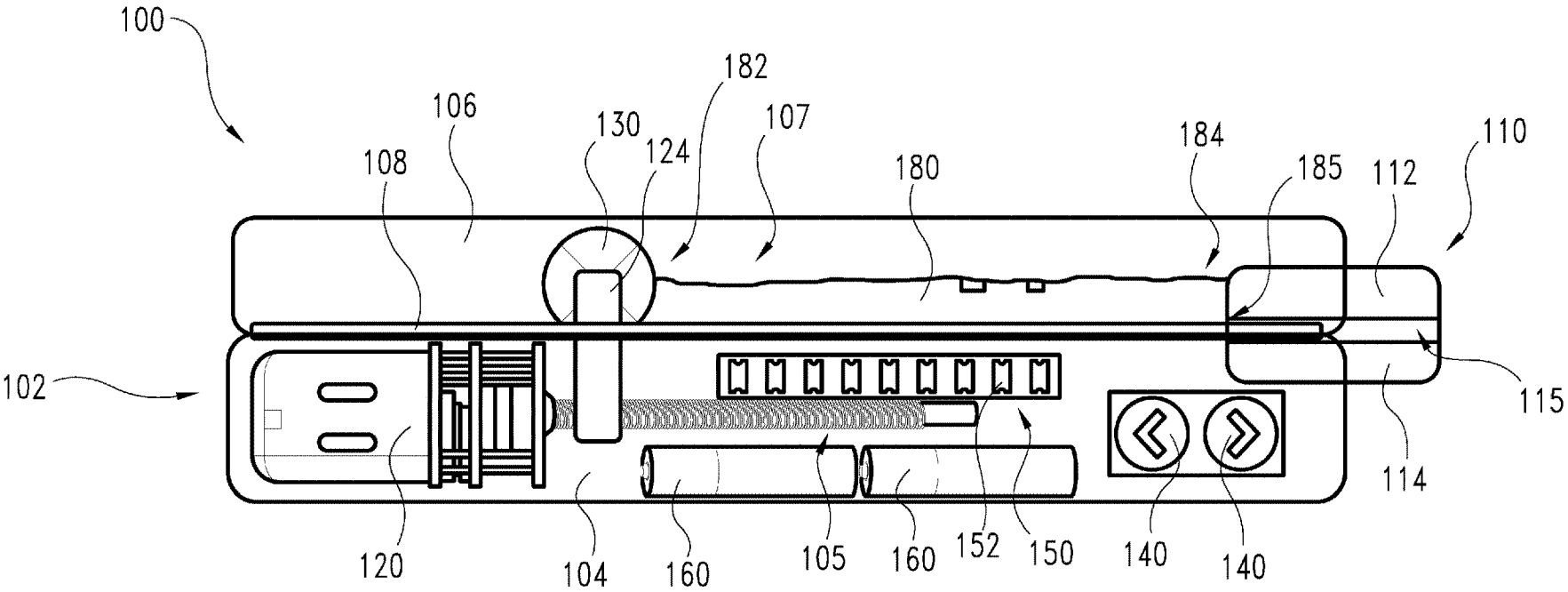
FIG. 1 is a side view of a dispenser for products in a flexible tube.
Figure 2:
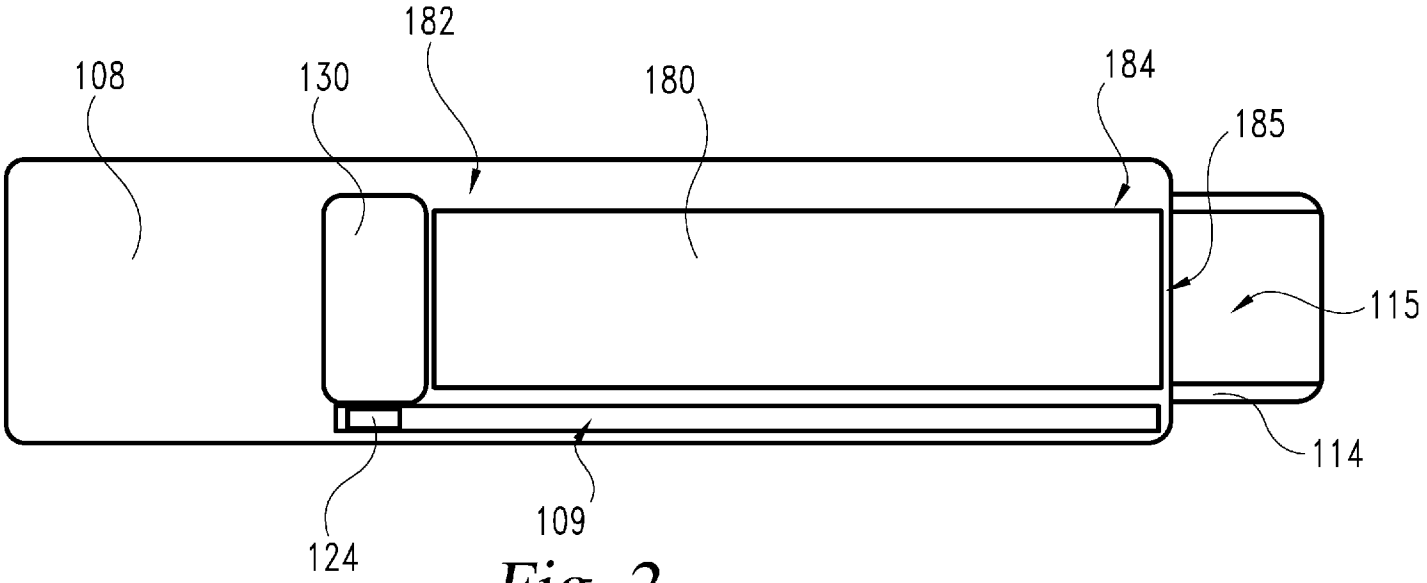
FIG. 2 is a cut-away top view of the dispenser of FIG. 1.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 illustrates an embodiment of a dispenser 100 used for dispensing a product from a flexible container or pouch, such as flexible tube 180. The dispenser 100 includes a shell 102. The shell 102 is formed from a base 104 and a lid 106. In some embodiments, the lid 106 may be attached to the base 104 at a hinge, allowing a user to pivot the lid 106 with respect to the base 104. A base cavity 105 is defined within the base 104. A lid cavity 107 is defined within the lid 106. The shell 102 also includes a support surface 108 for receiving and supporting the flexible tube 180 or another structure from which a liquid or a substance is to be dispensed. The support surface 108 may be positioned between the base 104 of the shell 102 and the lid 106 of the shell 102.

A mouthpiece 110 may be removably attached to the shell 102 and extends from the shell 102. In the embodiment shown, the mouthpiece 110 includes a first section 112 and a second section 114 with a mouthpiece opening 115 defined between the first section 112 and the second section 114. The first section 112 is attached to the shell 102 at the lid 106 and the second section 114 of the mouthpiece 110 is attached to the base 104 of the shell 102.

In some embodiments, the mouthpiece 110 may be adjustable to increase the size of the mouthpiece opening 115 or decrease the size of the mouthpiece opening 115 as desired. Additionally, the mouthpiece 110 may be removable from the shell 102. The mouthpiece 110 may be cleaned and then replaced to be reused. In other embodiments, the mouthpiece 110 may be discarded and a new mouthpiece 110 may be attached to the shell 102.

A motor 120 is positioned within the base cavity 105. The motor 120 includes a motor rod 122 that extends within the base cavity 105. A connecting rod 124 is coupled to the motor rod 122. The connecting rod 124 may extend through a slot 109 defined through the support surface 108 of the lid 106. The connecting rod 124 is attached to a dispensing tool, such as a roller 130, that is positioned within the lid cavity 107.

In FIG. 1, the roller 130 has a circular cross-section and is able to roll across the support surface 108. However, in other embodiments different dispensing tools may be used to apply pressure to a flexible tube 180 that is placed within the shell 102. For example, the dispensing tool may have a rectangular cross-section or a square cross-section and may be slid across the support surface 108 rather than roll across the support surface 108, or two rollers may be utilized which work cooperatively.

In the embodiment shown, the motor rod 122 is threaded and received within a threaded opening defined through the connecting rod 124. The motor 120 rotates the motor rod 122, causing the connecting rod 124 to move transversely along the threads of the motor rod 122. In turn, the movement of the connecting rod 124 along the threads of motor rod 122 causes the roller 130 to roll along the support surface 108. The direction of movement of the roller 130 along the support surface 108 may be reversed by reversing the direction of operation of the motor 120. In other embodiments, other suitable methods of moving the connecting rod 124 along the motor rod 122 may be used to cause the roller 130 to roll along the support surface 108.

One or more actuators 140 may be positioned on the exterior of the shell 102 to allow a user to control the direction of movement of the roller 130 within the lid cavity 107. The actuators may be mechanically or electrically connected to the motor 120 to control the direction of operation of the motor 120. In the embodiment shown, the actuators 140 are a pair of push buttons that are positioned on the base 104. However, in other embodiments, other suitable actuators 140 may be used to control the operation of the motor 120. For example, the actuator 140 may be a lever that may be switched between multiple positions to allow for the motor 120 to be switched off, rotated in a first direction, or rotated in a second direction. The position of the one or more actuators 140 may also be modified as desired. For example, in other embodiments, the actuators 140 may be positioned on the lid 106.

The dispenser 100 may also include an indicator display 150 positioned on the exterior of the shell 102 or visible to a user through the shell 102. The indicator display 150 may be used to display information regarding the status of the flexible tube held within the shell 102. In the embodiments shown, the indicator display is formed by a series of lights 152 that is positioned on the base 104 of the shell 102. In this embodiment, the series of lights 152 includes nine individual lights that may be lit different colors to indicate the position of the roller 130 within the lid cavity 107 and, in turn, how close the flexible tube within the lid cavity 107 is to being empty. In other embodiments, the indicator display 150 may include more or fewer lights 152 as desired. In still other embodiments, the indicator display 150 may be a digital display or any other suitable display for showing the status of the flexible tube within the shell 102.

In some embodiments, the motor 120 is powered by one or more power source. In one example, the power source may be one or more batteries 160. The one or more batteries 160 may be positioned within the base cavity 105 and may accessible by a user to be removed and replaced when desired. The one or more batteries 160 may also be used to power the indicator display 150. One or batteries 160 may be conventional AAA, AA, C or D cell consumer batteries or may be rechargeable batteries known to those of skill in the art.

In some embodiments, additional components may be positioned within the shell 102 or attached to the exterior of the shell 102 for entertainment of the user. For example, additional lighting may be visible on the shell 102. The lighting may include different colors and may flash in different patterns to entertain a user. There also may be games or fidget devices integrated into or attached to the shell 102.

In use, a user places a flexible tube 180 holding a substance to be dispensed on the support surface 108 within the lid cavity 107. A rear end 182 of the flexible tube 180 is positioned near the roller 130. A front end 184 of the flexible tube 180 is positioned near the mouthpiece 110 so that a tube opening 185 is in fluid communication with the mouthpiece opening 115. The user pushes an actuator 140 to operate the motor 120 so that the motor 120 moves the roller 130 along the length of the flexible tube 180. As the roller 130 moves along the flexible tube 180, the substance within the flexible tube 180 is expelled from a tube opening 185 at the front end 184 of the flexible tube 180 into the mouthpiece opening 115 of the mouthpiece 110. The user may remove the substance from the mouthpiece opening 115 either through the use of suction or by further advancing the roller 130 to squeeze additional substance from the flexible tube 180 that will push the substance out of the mouthpiece 110.

When the flexible tube 180 has been emptied, the user may operate one of the actuators 140 to reverse the direction of operation of the motor 120 to retract the roller 130 from its position near the front end 184 of the flexible tube 180 back to the starting position adjacent to the rear end 182 of the flexible tube 180. Alternatively, the dispenser 100 may have an automated or user selected reset operation which retracts the roller 130 and resets the dispenser 100 for loading/unloading. The user may then pivot the lid 106 with respect to the base 104 to gain access to the lid cavity 107. The flexible tube 180 may then be removed from the lid cavity 107, and a new flexible tube 180 may be inserted or the lid cavity 107 may be left empty until the next use.

In some embodiments, the dispenser 100 may have different operational modes for dispensing substances of different consistencies. For example, the dispenser 100 may have first operational mode for dispensing a substance that is a liquid or a gel. The dispenser may have a second operational mode for a dispensing a more solid substance or a frozen or semi-frozen liquid or gel. The operational modes may differ by the amount of force applied by the dispensing tool and/or by the movement of the dispensing tool. For example, in the second operational mode for dispensing a frozen liquid or gel or a more solid substance, the dispenser 100 may be configured to allow the roller 130 to apply greater force to the flexible tube 180 to dispense the frozen or solid substance from the flexible tube 180. In some embodiments, the roller 130 may also be primed to rock back and forth along certain portions of the flexible tube 180 to make the frozen or solid substance easier to dispense. In these instances, the motor 120 may reverse direction several times to move the roller 130 in a rocking motion.

Figure 3:
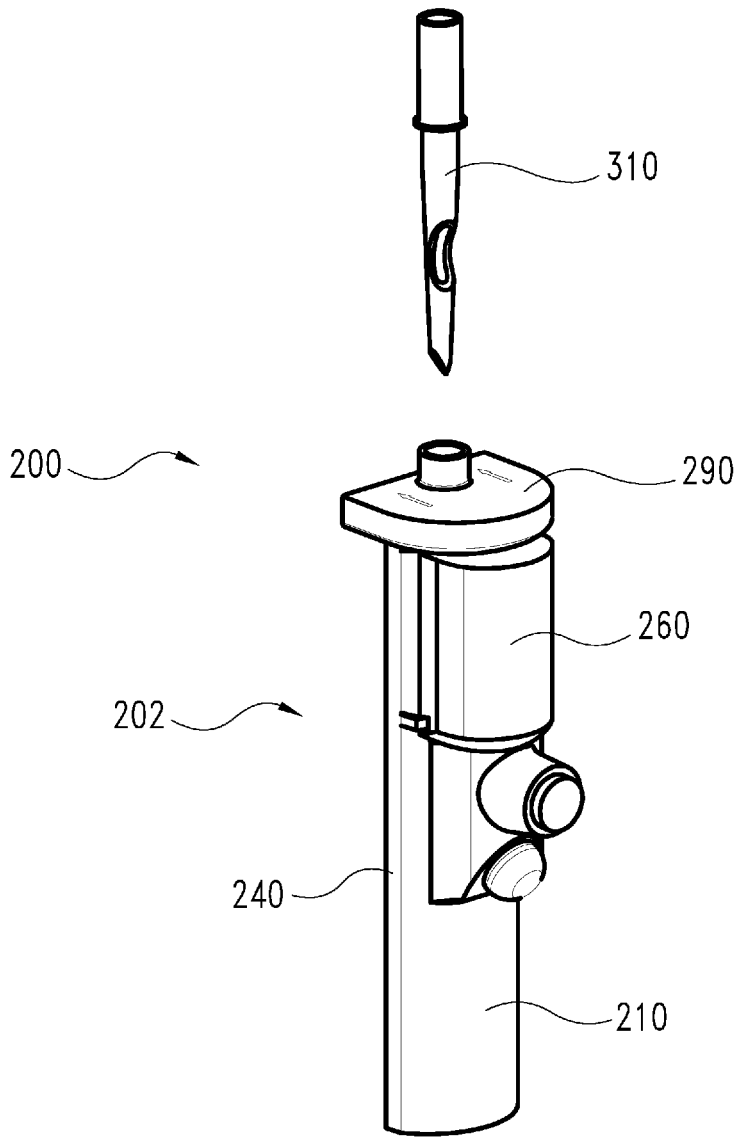
FIG. 3 is a front perspective view of a dispenser for products in a flexible tube.

Another embodiment of a dispenser 200 used for dispensing a product from a flexible tube is shown in FIG. 3. The dispenser 200 includes a shell 202 that, in the embodiment shown in FIG. 3, is formed from a base housing 210 and a slider housing 240 that may be removably coupled to the base housing 210. Although the shell 202 is shown as being formed from two separate, attachable housings, in other embodiments, the shell 202 may be a unitary structure, or the shell 202 may be formed by three or more separate, attachable housings. A dispenser opening 205 is defined within an interior of the shell 202. For example, the dispenser opening 205 is defined between the base housing 210 and the slider housing 240 when the base housing 210 is attached to the slider housing 240.

A control housing 260 is positioned on an exterior surface the base housing 210 and a dispenser cap, such as slider cap 290, may be removably attached to the shell 202. The dispenser 200 also includes mouthpiece assembly 310 that is capable of piercer a flexible tube that is held within the dispenser 200 and which may act as a conduit for dispensing the contents within the flexible tube.

Figure 4B:
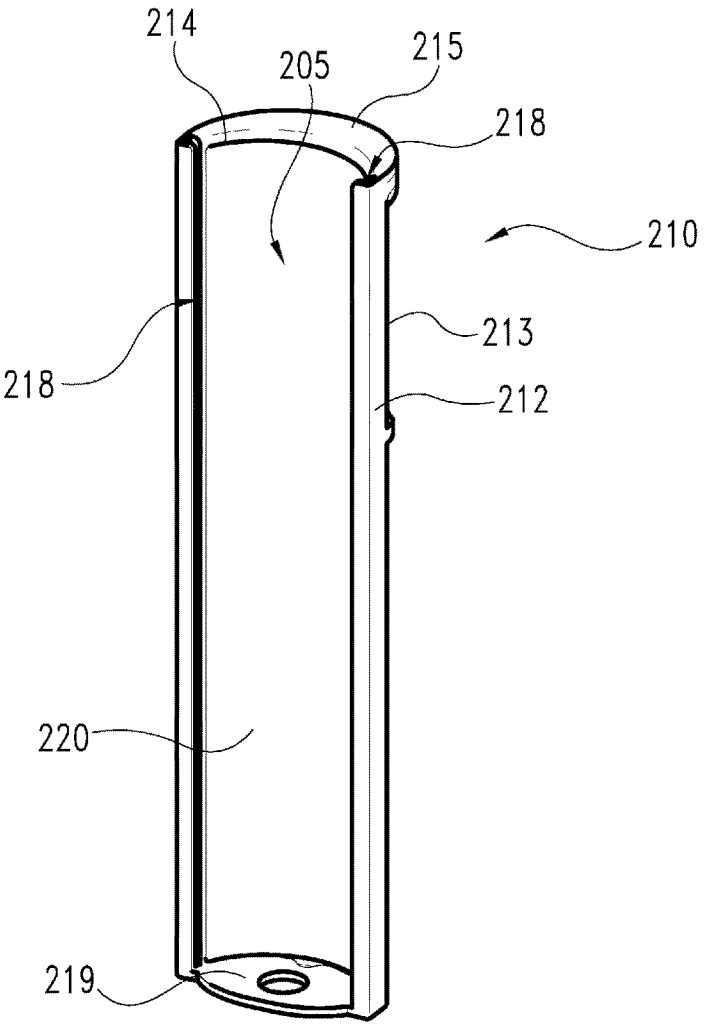
FIG. 4B is a rear perspective view of the base housing of FIG. 4A.
Figure 4A:
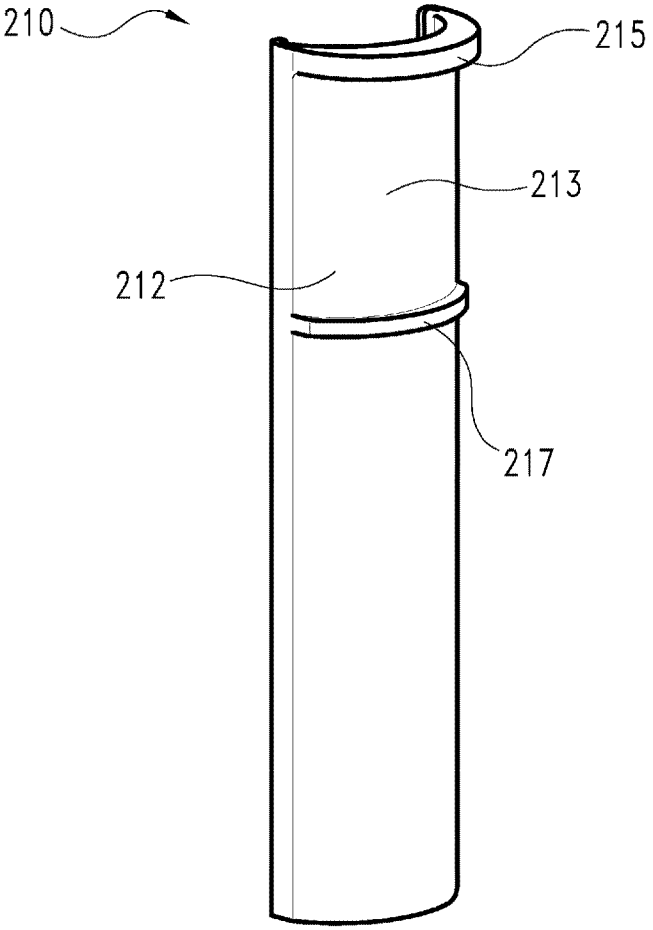
FIG. 4A is a front perspective view of a base housing of the dispenser of FIG. 3.

The base housing 210 is shown in more detail in FIGS. 4A-4B. FIG. 4A illustrates a front perspective view of the base housing 210 and FIG. 4B illustrates a rear perspective view of the base housing 210. As shown, the base housing 210 includes a base housing body 212 that has an outer surface 213 and an inner surface 214. The base housing 210 includes a base housing cap 215 that extends from a top edge of the base housing body 212. Additionally, a ledge 217 extends from the outer surface 213 of the base housing body 212. In some embodiments, the ledge 217 may be used as a support that assists to secure the control housing 260 to the base housing 210.

In the embodiment shown, the base housing body 212 is U-shaped so that the base housing body 212 has a semi-circular cross section. A groove 218 is defined at the edges of the inner surface 214 and extends along the length of the base housing body 212. The base housing body 212 also includes a base housing base 219 that extends substantially perpendicularly from the inner surface 214 at the bottom edge of the base housing body 212.

Figure 16:
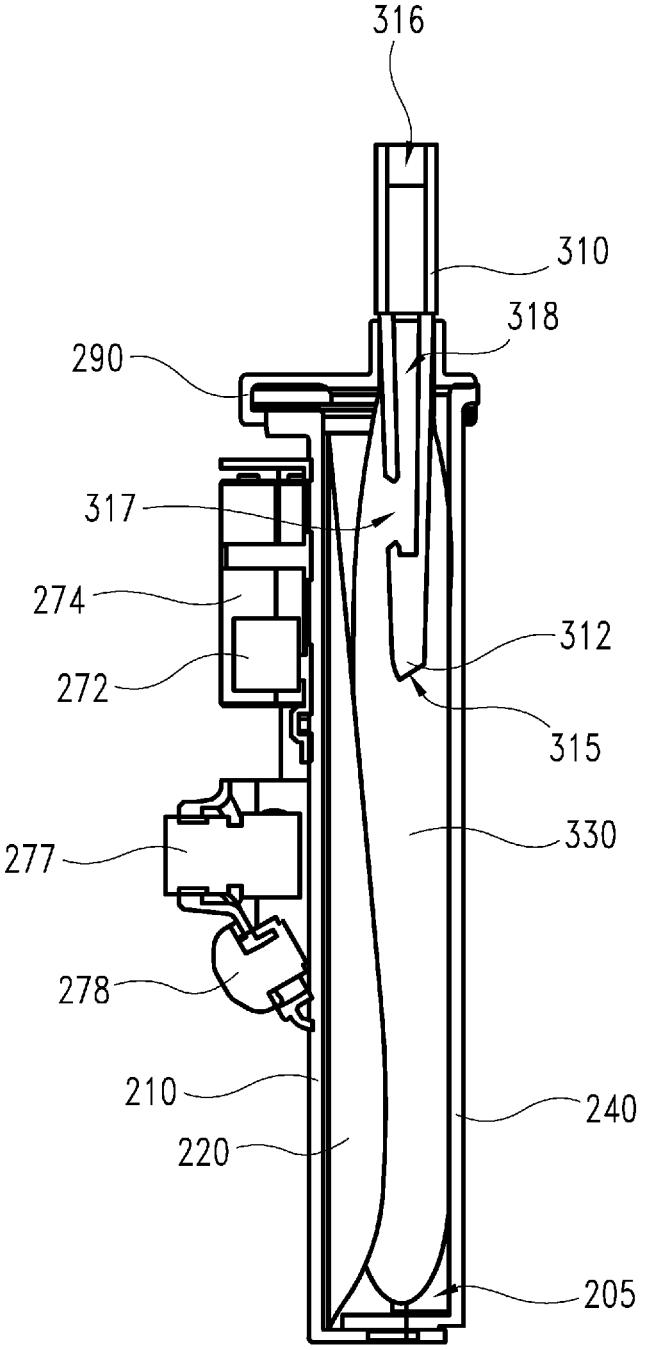
FIG. 16 is a cross-sectional view of a flexible tube inserted into the dispenser of FIG. 1 and the bladder of the dispenser in an inflated state.

An inflatable bladder 220 is attached to the inner surface 214 of the base housing body 212, and acts as a dispensing tool for dispensing a product from a flexible tube positioned within the dispenser 200. In the embodiment shown, the bladder 220 extends between the grooves 218 defined through the inner surface 214 and extends the length of the base housing body 212 from the top edge of the base housing body 212 to the base housing base 219. In FIG. 4, the bladder 220 is shown in an uninflated state. The bladder 220 may be inflated so that the bladder 220 expands into the dispenser opening 205 when the base housing 210 is attached to the slider housing 240 (see FIG. 16). In one form, the bladder 220 is biased in either shape or inflation so as to urge the material within the container out from the container through its opening and not so as to capture and compress it within.

Figure 5B:
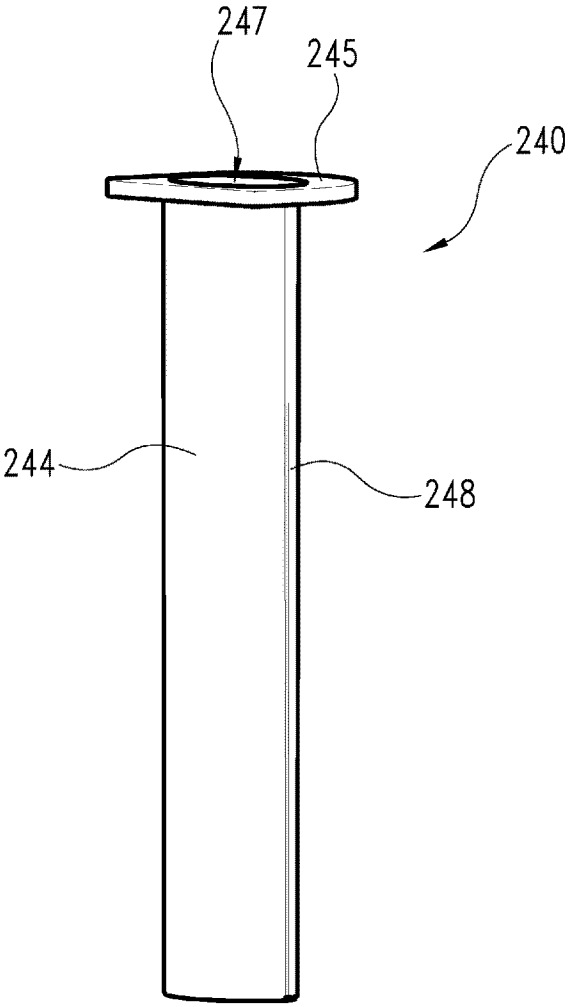
FIG. 5B is a rear perspective view of the slider housing of FIG. 5A.
Figure 5A:
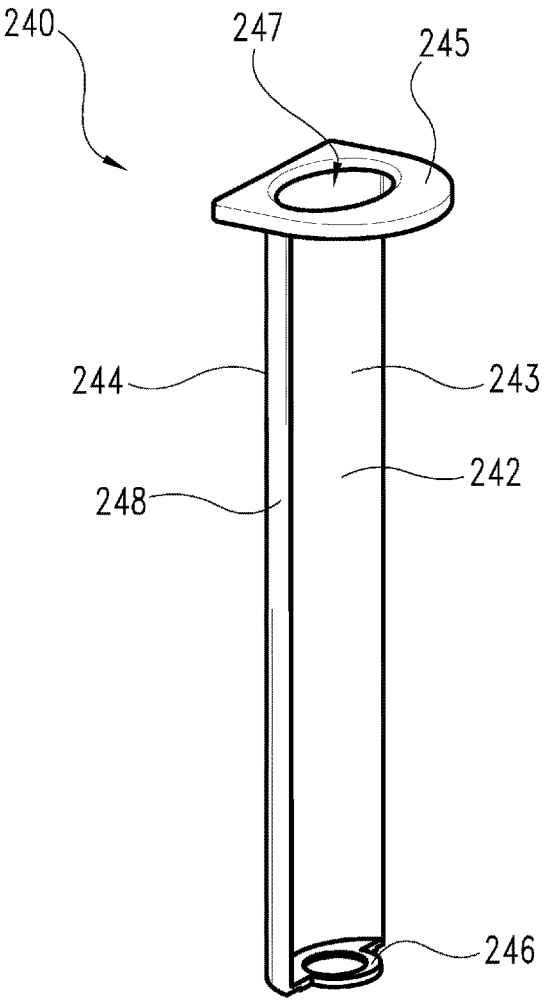
FIG. 5A is a front perspective view of a slider housing of the dispenser of FIG. 3.

The slider housing 240 is shown in more detail in FIGS. 5A-5B. FIG. 5A illustrates a front perspective view of the slider housing 240 and FIG. 5B illustrates a rear perspective view of slider housing 240. The slider housing 240 includes a slider housing body 242 including a slider inner surface 243 and a slider outer surface 244. In the embodiment shown, the slider housing body 242 is curved so that the cross-section of the slider housing body 242 has a semi-circular shape. The slider housing also includes a slider housing cap 245 positioned at a top edge of the slider housing body 242, and slider base 246 positioned at a bottom edge of the slider housing body 242. A slider cap opening 247 is defined through the slider housing cap 245. A slider protrusion 248 extends from the slider outer surface 244 at each side edge of the slider housing body 242. Each of the slider protrusions 248 is configured to slidably fit within a respective groove 218 of the base housing 210 to allow the slider housing 240 to slidably mate to the base housing 210.

Figure 6:
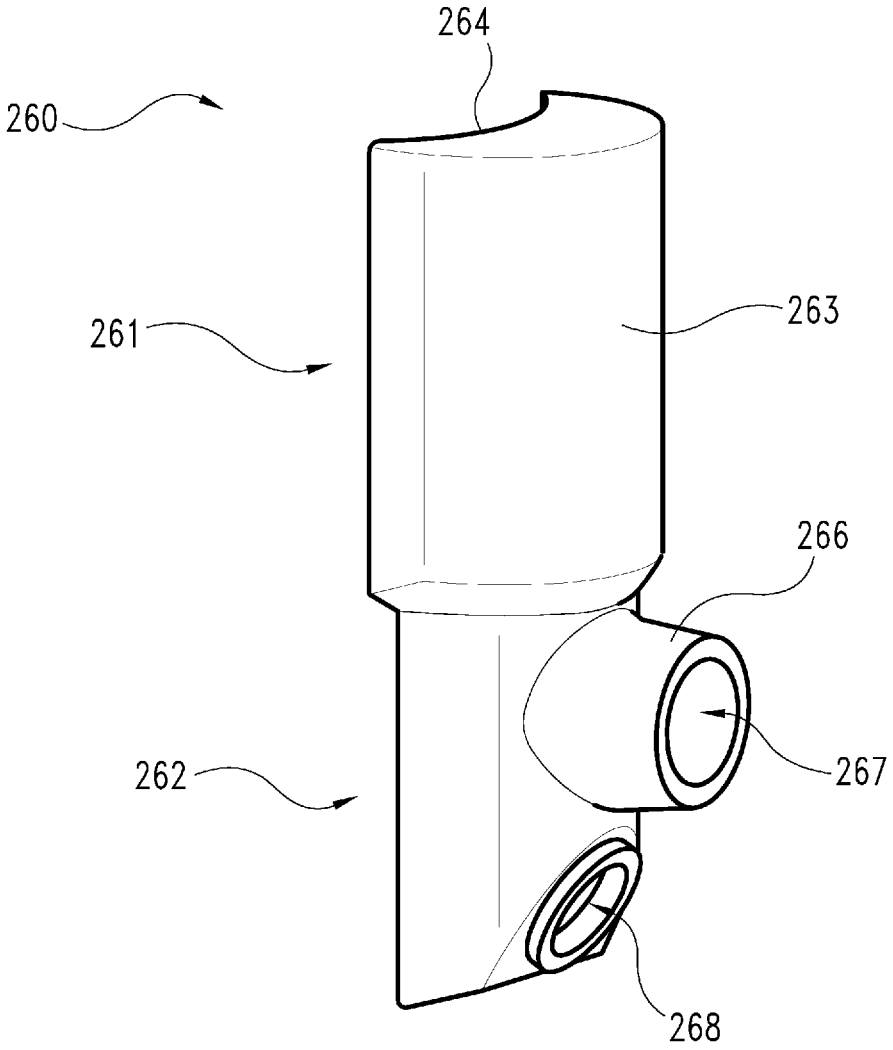
FIG. 6 is a front perspective view of control housing of the dispenser of FIG. 3.

A front perspective view of the control housing 260 is shown in FIG. 6. The control housing 260 includes a control housing upper portion 261 and a control housing lower portion 262. The control housing upper portion 261 has an outer surface 263 and an inner surface 264. The inner surface 264 of the control housing upper portion 261 is curved to correspond to the curvature of the outer surface 213 of the base housing 210. In the embodiment shown, the outer surface 263 of the control housing upper portion 261 is also curved.

The control housing lower portion 262 includes a pressure release valve opening 267. In the embodiment shown, the pressure release valve opening 267 is defined through a release valve extension 266 that extends from the surface of the control housing lower portion 262. An inflation actuator opening 268 is also defined through the control housing lower portion 262.

Figure 7:
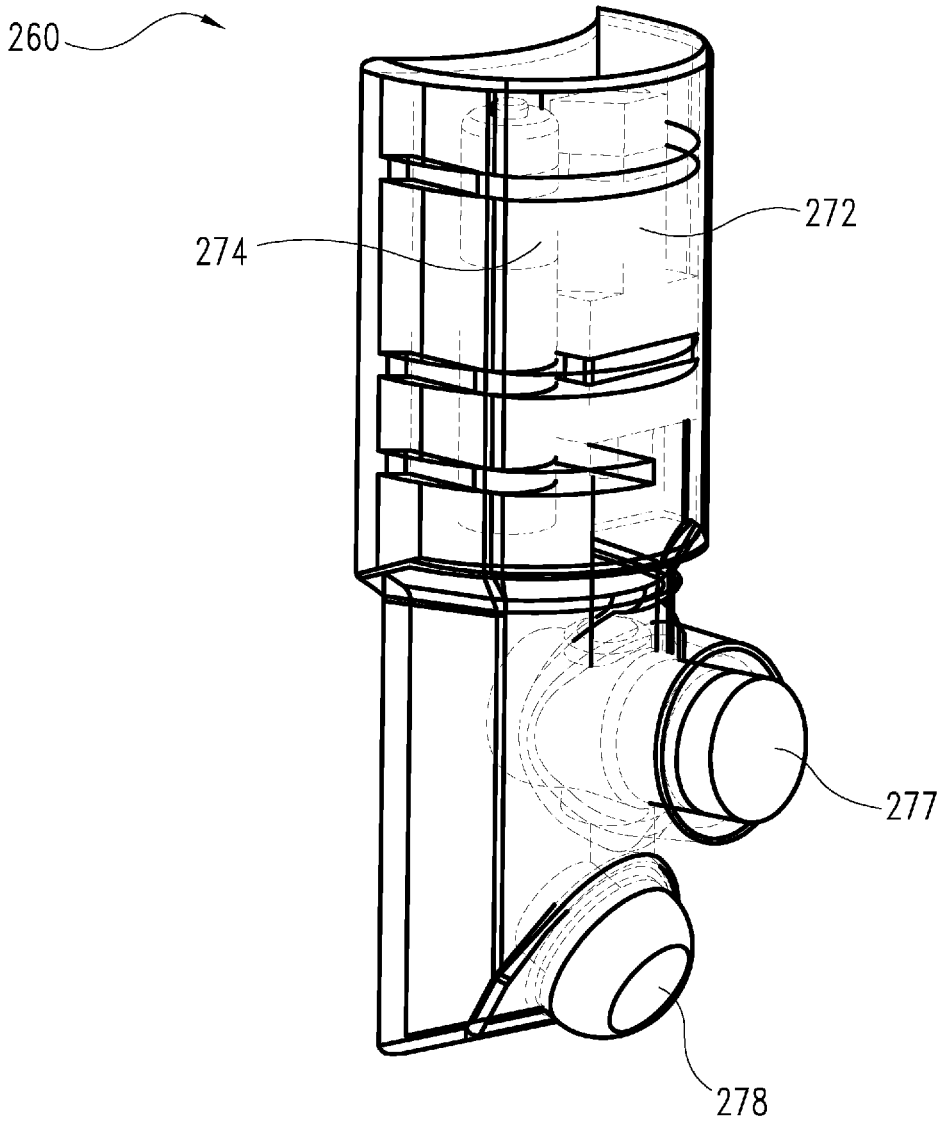
FIG. 7 is a transparent view of the control housing of FIG. 6.

A transparent view of the control housing 260 is shown in FIG. 7 to allow for a better view of the interior of the control housing 260. As illustrated, the control housing upper portion 261 may include a motor 272 that is used to inflate the bladder 220 attached to the inner surface 214 of the base housing 210. The control housing upper portion 261 may also house a power source 274, such as a battery or other suitable source of power, for operating the motor 272. In the embodiment shown, the motor 272 is a 1.5 V motor, but in other embodiments different motors suitable for inflating the inflatable bladder 220 may be used. In some embodiments, the control housing 260 may include a door on the outer surface 263 that allows easy access to the power source 274, so that the power source 274 may be easily changed if necessary.

A pressure release valve 277 is positioned in the pressure release valve opening 267. The pressure release valve 277 may be a rotational valve, a threaded valve, a pinch valve, or any other type of valve suitable for allowing air to be released from the inflatable bladder 220 to deflate the bladder 220. An inflation actuator 278 is positioned in the inflation actuator opening 268. The inflation actuator 278 is operationally connected to the motor 272 so that the inflation actuator 278 may be pressed, rotated, translated, or otherwise operated to cause the motor 272 to be turned on and/or turned off to inflate the inflatable bladder 220.

Figure 8:
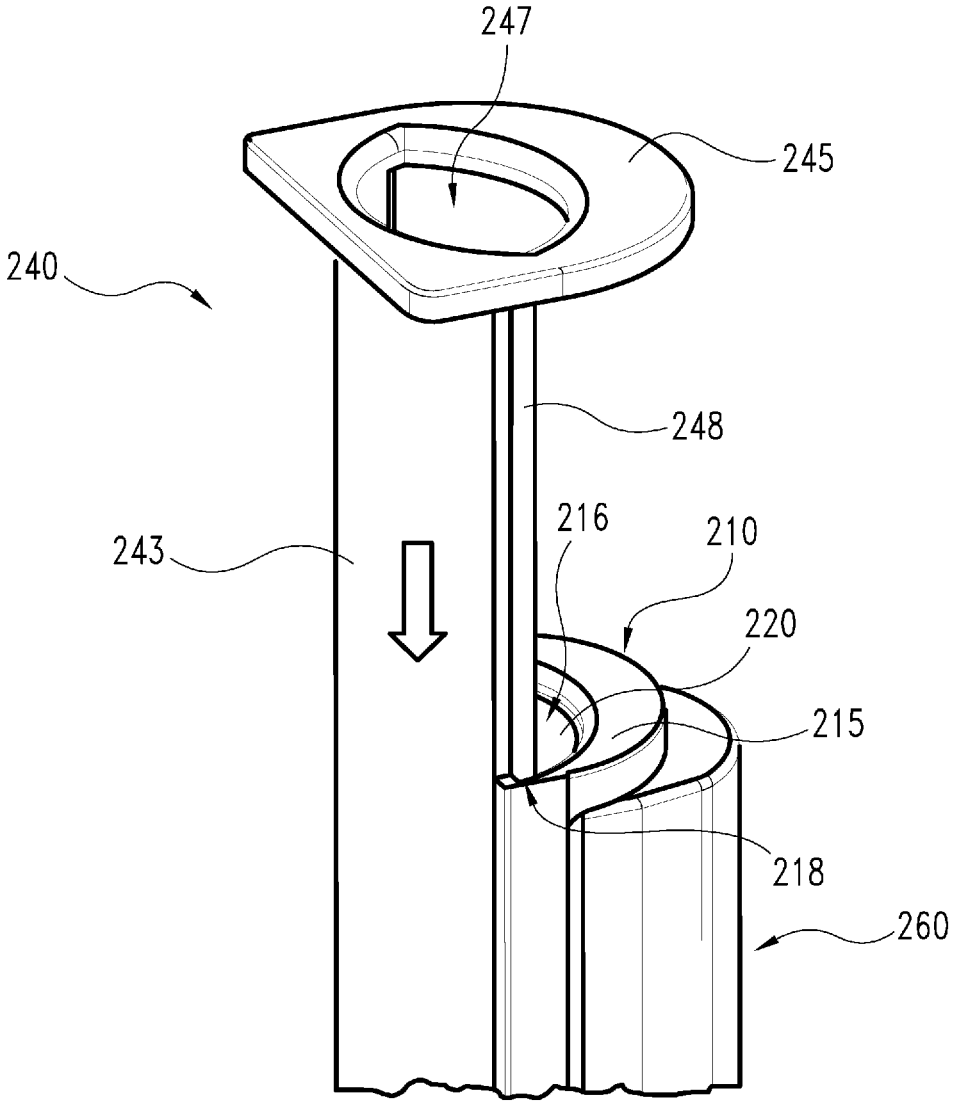
FIG. 8 is a rear perspective view of the slider housing of FIG. 5A being coupled to the base housing of FIG. 4A.

As shown in FIG. 8, the dispenser 200 may be assembled by aligning the slider protrusions 248 on the slider housing 240 with the grooves 218 of the base housing 210 and then sliding the slider protrusions 248 within the grooves 218 so that the slider housing 240 slides along the length of the base housing 210 within the dispenser opening 205. The slider housing 240 is slid along the length of the base housing 210 until the slider housing cap 245 comes into contact with the base housing cap 215 (e.g., see FIG. 9). The contact between the slider housing cap 245 and the base housing cap 215 prevents the slider housing 240 from moving any further along the length of the slider housing. When the slider housing 240 is attached to the base housing 210, the slider cap opening 247 defined through the slider housing cap 245 is in communication with the dispenser opening 205 defined between the slider housing 240 and the base housing 210.

Figure 9:
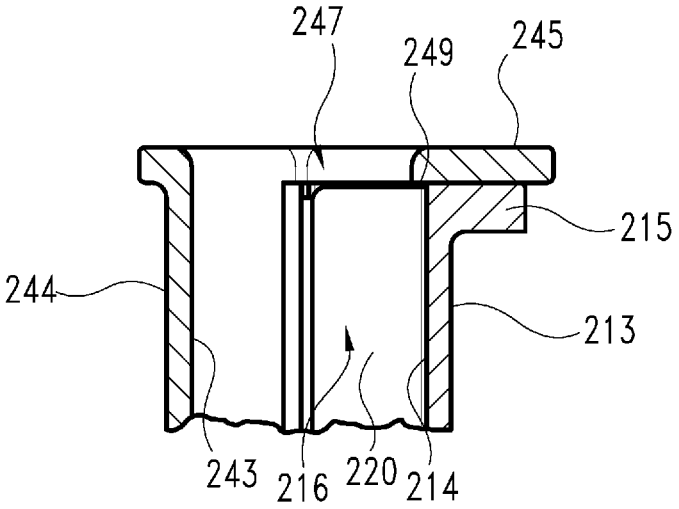
FIG. 9 is a partial cross-sectional view of the top portion of the slider housing of FIG. 5A when coupled to the base housing of FIG. 4A.

FIG. 9 shows a cross-sectional view of the top portion of the base housing 210 and the slider housing 240 in an assembled configuration where the base housing 210 is attached to the slider housing 240. As shown, the slider housing cap 245 has a length that is larger than the length of the base housing cap 215 so that the slider housing cap 245 has an overhang portion 249 that extends past the inner edge of the base housing cap 215 and extends into the dispenser opening 205. The overhang portion 249 may protect the inflatable bladder 220 when the bladder 220 is deflated so that objects inserted into the dispenser 200 through the slider cap opening 247 do not contact the bladder 220 while being inserted.

Figure 10:
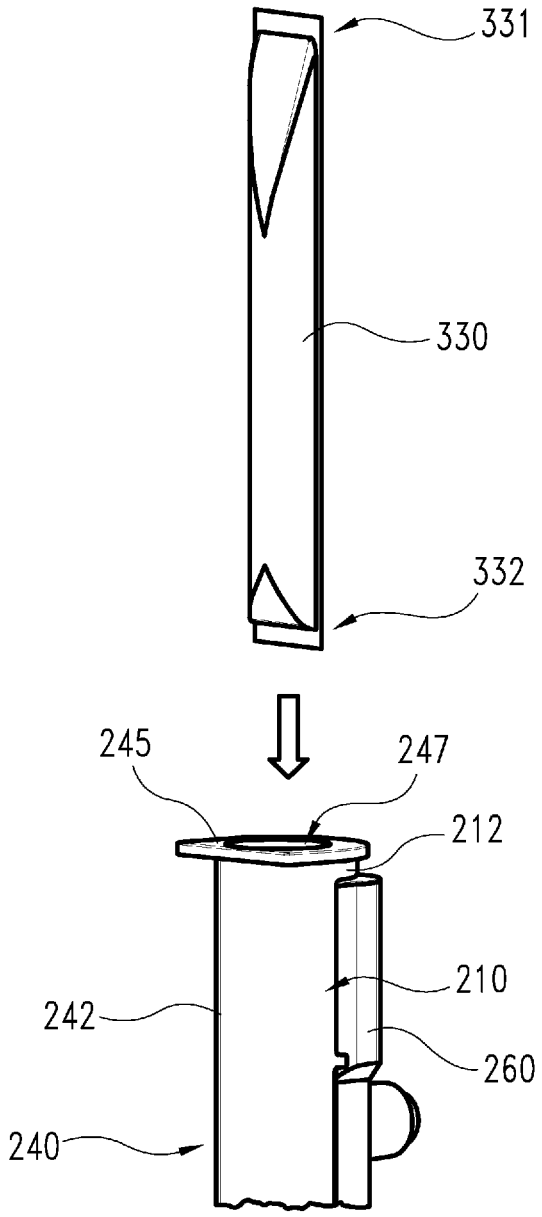
FIG. 10 is a partial rear perspective view of a flexible tube being inserted into the dispenser of FIG. 1.

As shown in FIG. 10, after the base housing 210 is attached to the slider housing 240, a flexible tube 330 may be inserted through the slider cap opening 247 of the slider housing and into the dispenser opening 205 defined between the base housing body 212 and the slider housing body 242. The flexible tube 330 has a flexible tube top portion 331 and a flexible tube bottom portion 332. In some embodiments, the flexible tube 330 may be inserted through the slider cap opening 247 and into the dispenser opening 205 until the flexible tube bottom portion 332 comes into contact with the slider base 246 of the slider housing 240.

Figure 11:
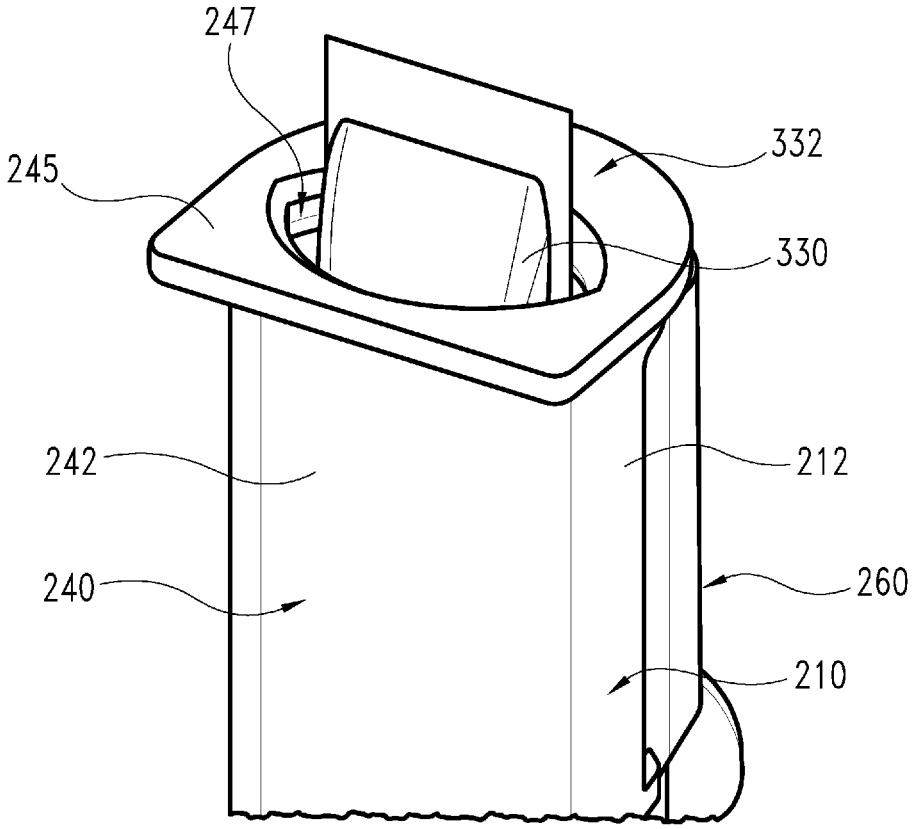
FIG. 11 is a partial rear perspective view of the flexible tube fully inserted into the dispenser of FIG. 1.

FIG. 11 illustrates the flexible tube 330 positioned within the dispenser opening 205 defined between the base housing 210 and the slider housing 240. The flexible tube 330 has a length that is slightly greater than the length of the base housing 210 and the slider housing 240, so that the flexible tube top portion 331 extends out of the slider cap opening 247.

Figure 12:
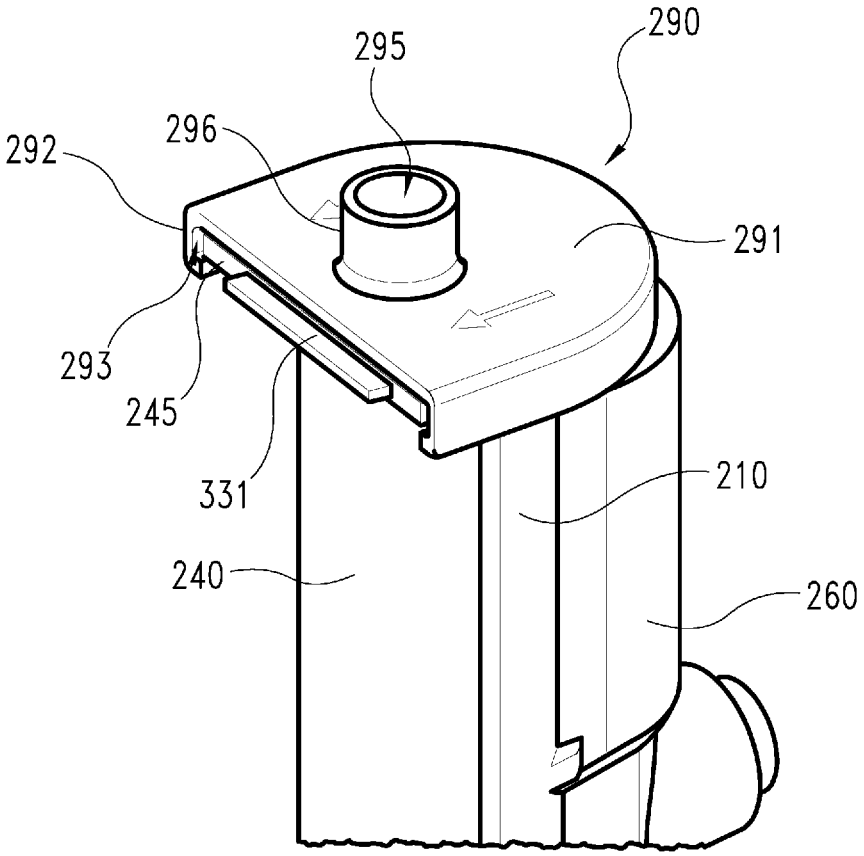
FIG. 12 is a rear perspective view of a slider cap attached to the slider housing and the base housing of the dispenser of FIG. 1.

As shown in FIG. 12, once the flexible tube 330 has been inserted into the dispenser opening 205, the slider cap 290 may be attached to the slider housing cap 245 to cover the slider housing 240 and the base housing 210. The slider cap 290 includes a top surface 291 and tracks 292 that extend from the top surface 291 around the edges of the slider cap 290. The tracks 292 define a gap 293 that is sized to receive the slider housing cap 245 so that the slider cap 290 may slide along the slider housing cap 245. As the slider cap 290 slides along slider housing cap 245, the slider cap 290 contacts the flexible tube top portion 331, causing the flexible tube top portion 331 to fold to be positioned substantially parallel to the top surface 291 of the slider cap 290. The slider cap also includes a slider cap hub 296 that extends from the top surface 291 of the slider cap 290. The slider cap hub 296 defines a slider cap opening 295 for receiving at least a portion of the mouthpiece assembly 310.

Figure 13:
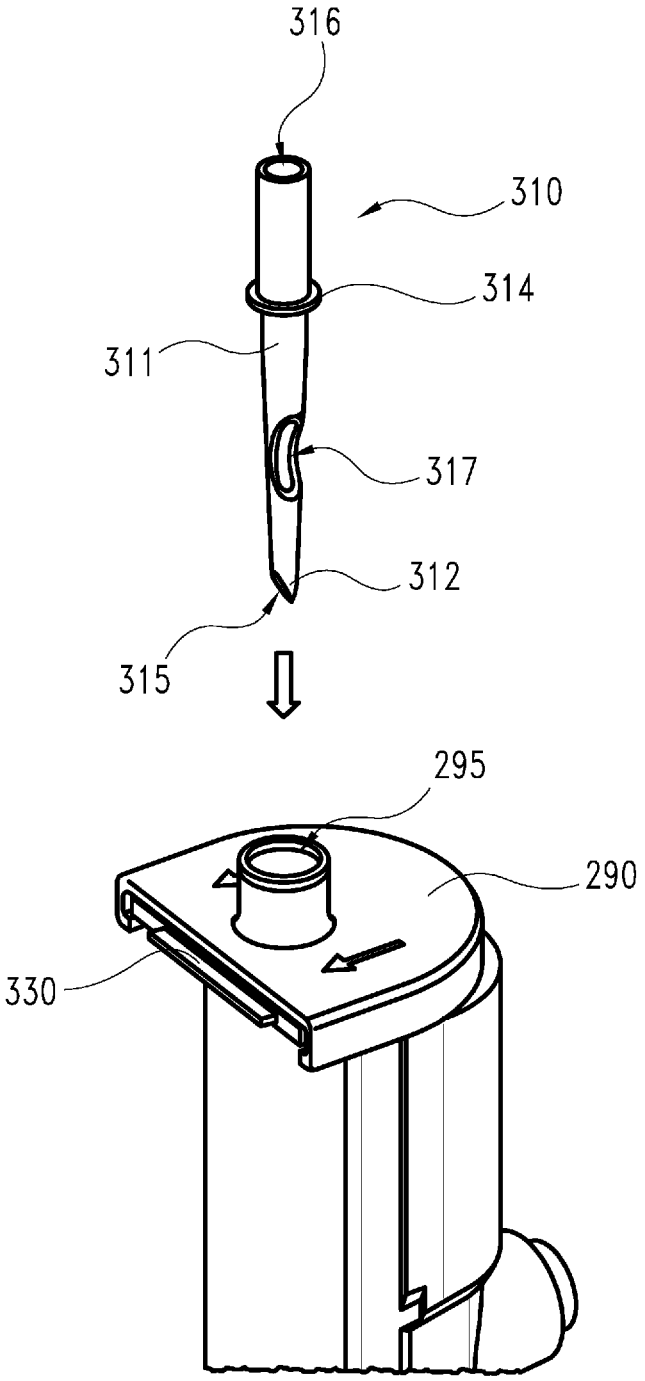
FIG. 13 is a rear perspective view of a mouthpiece assembly before assembly with the dispenser of FIG. 1.

After the slider cap 290 has been attached to the base housing 210 and the slider housing 240, the mouthpiece assembly 310 may be assembled with the base housing 210, the slider housing 240, and the slider cap 290. As shown in FIG. 13, the mouthpiece assembly 310 includes a mouthpiece body 311. In the embodiment shown, the mouthpiece body 311 is a cylindrical tube that defines a mouthpiece channel 318 (see FIGS. 15 and 16) that extends through the length of the mouthpiece body 311 from a bottom mouthpiece opening 315 to a top mouthpiece opening 316.

The mouthpiece body 311 tapers to a tapered bottom end 312. The tapered bottom end 312 may be sharp enough to allow the mouthpiece body 311 to pierce the flexible tube 330. The mouthpiece assembly 310 also includes an extension ring 314 that surrounds and extends from the outer diameter of the mouthpiece body 311. A pressure release opening 317 is also defined through a side of the mouthpiece body 311. In the embodiment shown in FIG. 13, the pressure release opening is defined through the mouthpiece body 311 at a position above the tapered bottom end 312 but below the extension ring 314.

Figure 14:
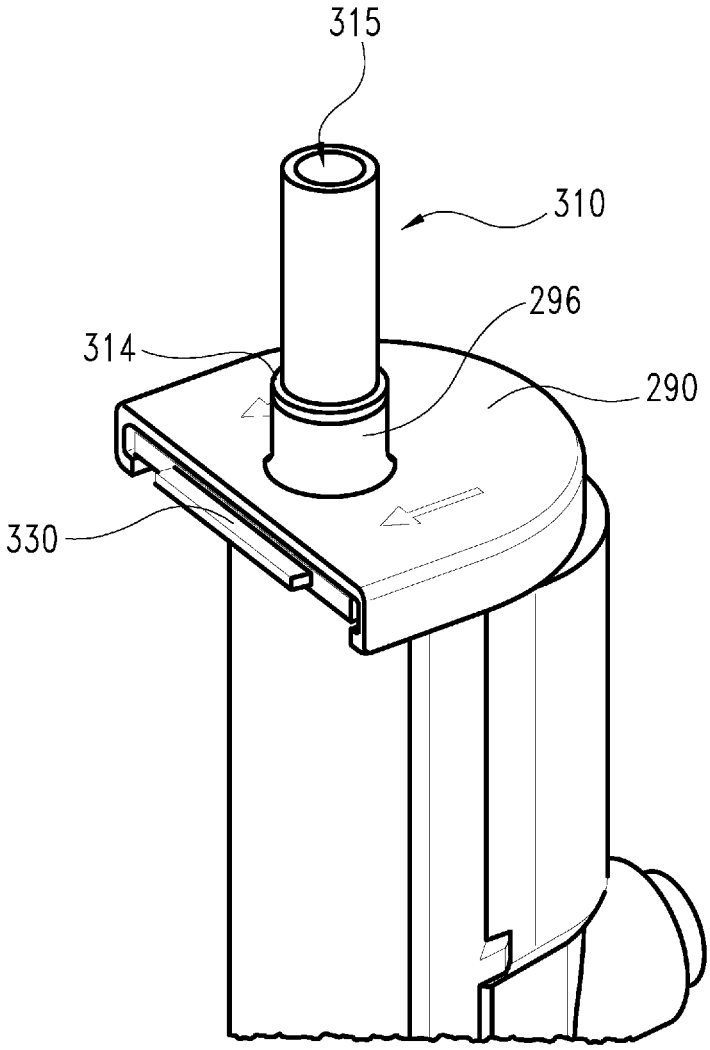
FIG. 14 is a rear perspective view of the mouthpiece assembly inserted into the dispenser of FIG. 1.

The mouthpiece assembly 310 may be inserted through the slider cap opening 295 of the slider cap 290, so that at least a portion of the mouthpiece body 311 enters the dispenser opening 205 defined between the base housing 210 and the slider housing 240. As the mouthpiece assembly 310 is inserted through the slider cap opening 295, the tapered bottom end 312 pierces the outer packaging of the flexible tube 330 that is positioned within the dispenser opening 205, allowing access to the contents of the flexible tube 330. As illustrated in FIG. 14, the travel of the mouthpiece assembly within the slider cap opening 295 is limited by the extension ring 314 that surrounds the mouthpiece body 311. The extension ring 314 has a diameter that is greater than the diameter of the slider cap opening 295 so that the extension ring 314 rests on the slider cap hub 296, impeding further travel of the mouthpiece body 311 within the dispenser opening 205.

Figure 15:
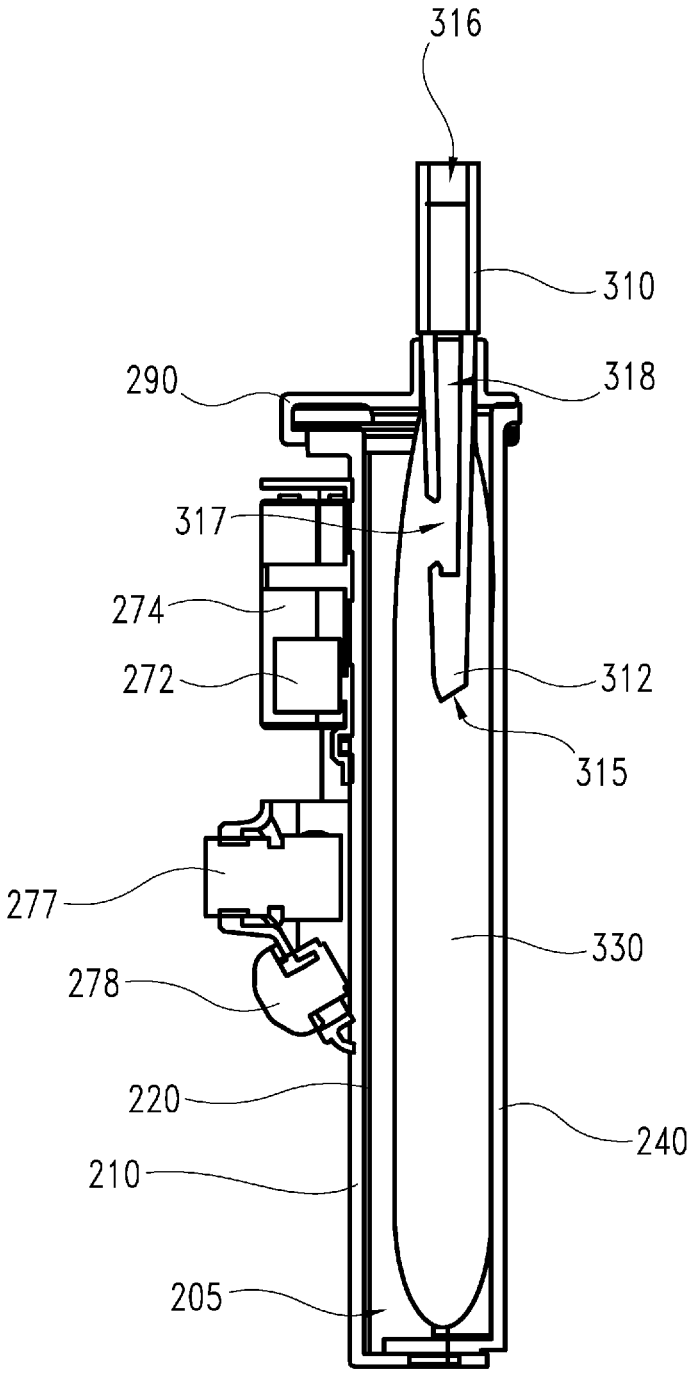
FIG. 15 is a cross-sectional view of a flexible tube inserted into the dispenser of FIG. 1 and the bladder of the dispenser in an uninflated state.

A cross-sectional view of the assembled dispenser 200 is shown in FIG. 15 with the flexible tube 330 positioned within the dispenser opening 205 and the inflatable bladder 220 in an uninflated stated. As shown, the mouthpiece assembly 310 has pierced the flexible tube 330 so that the tapered bottom end 312 of the mouthpiece assembly 310 is in fluid communication with the interior of the flexible tube 330. Since, the inflatable bladder 220 is uninflated, the bladder 220 places no force or minimal force on the flexible tube 330.

Once the dispenser 200 is fully assembled, a user may push and hold the inflation actuator 278 of the control housing 260 to inflate the bladder 220 within the base housing 210. As shown in the cross-sectional view of the dispenser illustrated in FIG. 16, as the bladder 220 inflates, the bladder 220 contacts and applies force on the flexible tube 330 within the dispenser opening 205, pushing the contents of the flexible tube 330 toward the tapered bottom end 312 of the mouthpiece assembly 310 which has pierced the flexible tube 330. With continued inflation of the bladder 220, the contents of the flexible tube 330 are pushed upward through the mouthpiece and dispensed from the top mouthpiece opening 316. In another form, the width of the dispenser opening 205 may vary or reduce along its length as it progresses from one end to toward the mouthpiece body 311 so as to enable the complete and efficient emptying of the flexible tube 330.

Once the desired contents of the flexible tube 330 have been dispensed from the dispenser 200, the user may release the inflation actuator 278 and may operate the pressure release valve 277 to deflate the bladder 220. In the embodiment shown, the pressure release valve 277 is pressed inward with respect to the control housing 260 to deflate the bladder 220; however, in other embodiments the pressure release valve 277 may be rotated, pulled, or activated in another suitable manner. In some instances, the bladder 220 may only be deflated partially to stop dispensing the contents of the flexible tube. In other instances, the bladder 220 may be fully deflated to allow disassembly of the dispenser 200 so that the flexible tube 330 may be removed from the dispenser opening 205.

Figure 17:
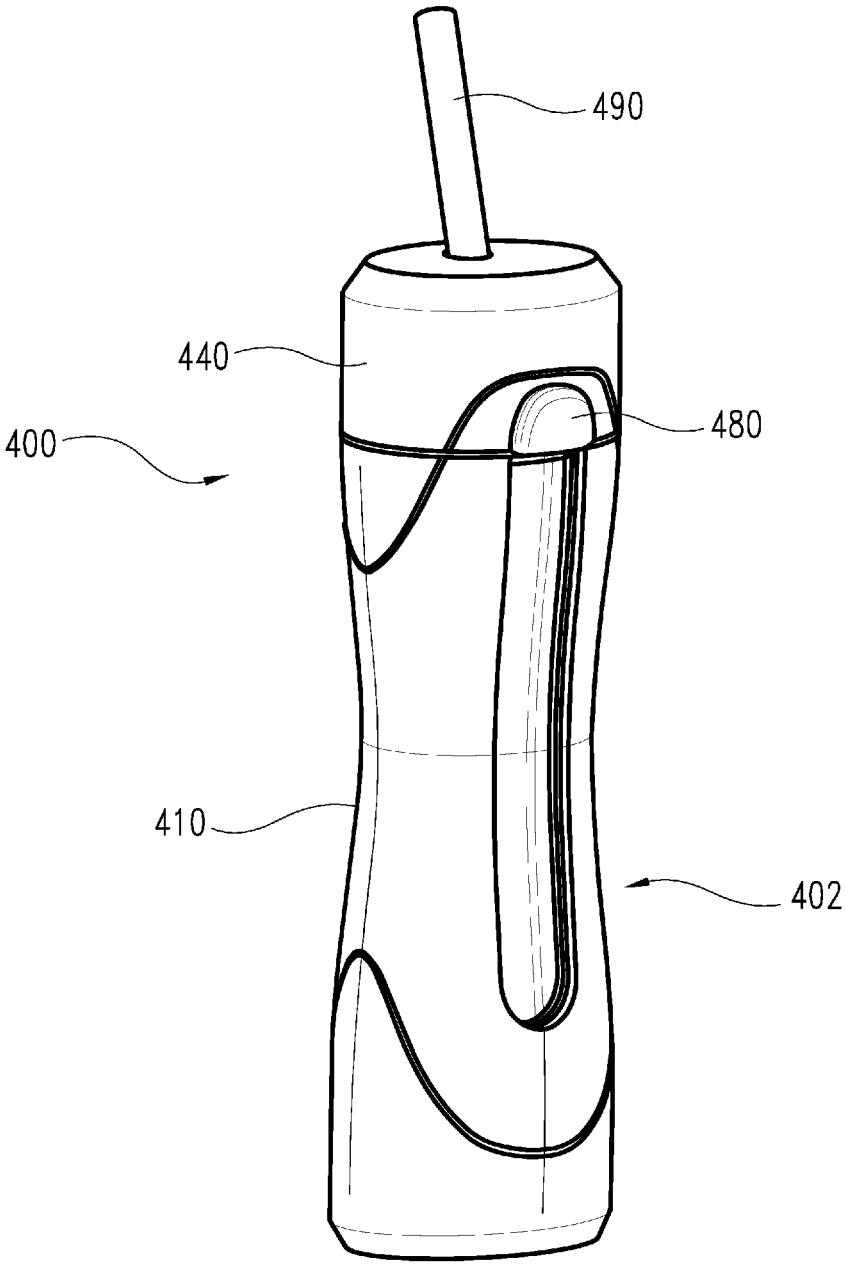
FIG. 17 is a front perspective view of a dispenser for products in a flexible tube.

An alternative embodiment of a dispenser 400 is illustrated in FIG. 17. Dispenser 400 includes a shell 402 that comprises a base housing 410 that defines a dispenser opening 405 (see FIG. 19) within an interior of the shell 402. A dispenser cap 440 is hingedly attached to the shell 402 at the base housing 410. The dispenser cap 440 may be hinged between an open position that allows access to the dispenser opening 405 and a closed position that prevents access to the dispenser opening 405. A dispenser cap release 480 may be operated to move the dispenser cap 440 between the closed position and the open position. The dispenser 400 also includes a mouthpiece assembly 460 (see FIG. 19) that includes a mouthpiece insert 490 that is removably engageable with the dispenser cap 440.

Figure 18:
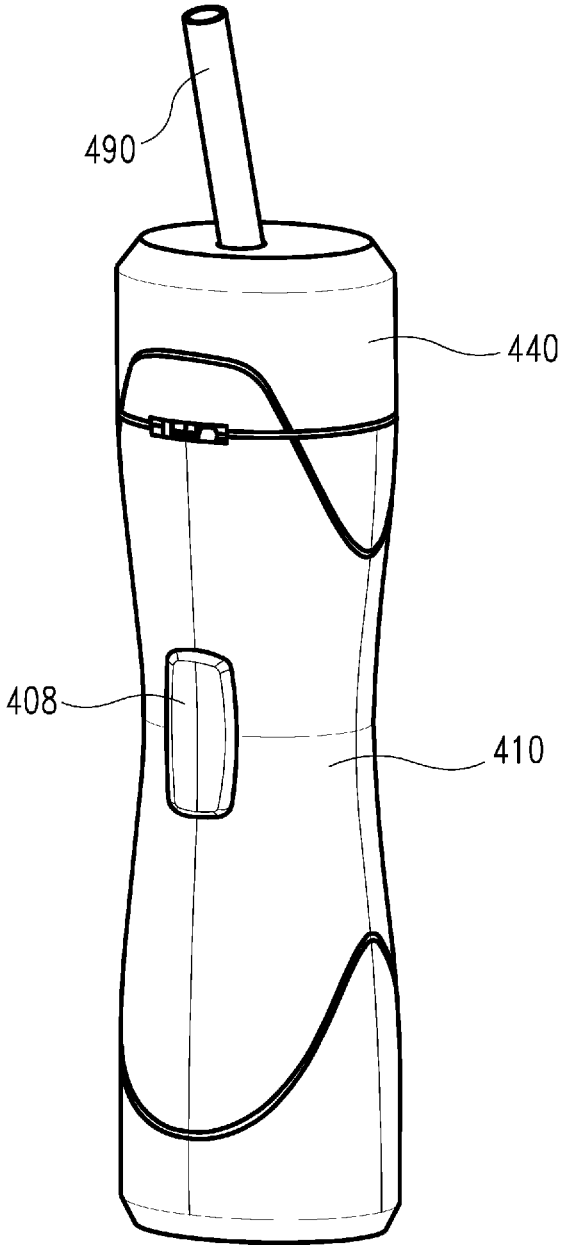
FIG. 18 is a rear perspective view of the dispenser of FIG. 17.

A rear view of the dispenser 400 is shown in FIG. 18. As shown, an inflation actuator 408 is attached to the base housing 410 of the shell 402. The inflation actuator 408 is operatively connected to an inflatable bladder 420 positioned within the dispenser opening 405. In some embodiments, depressing the inflation actuator 408 causes the bladder 420 to inflate within the dispenser opening.

Figure 19:
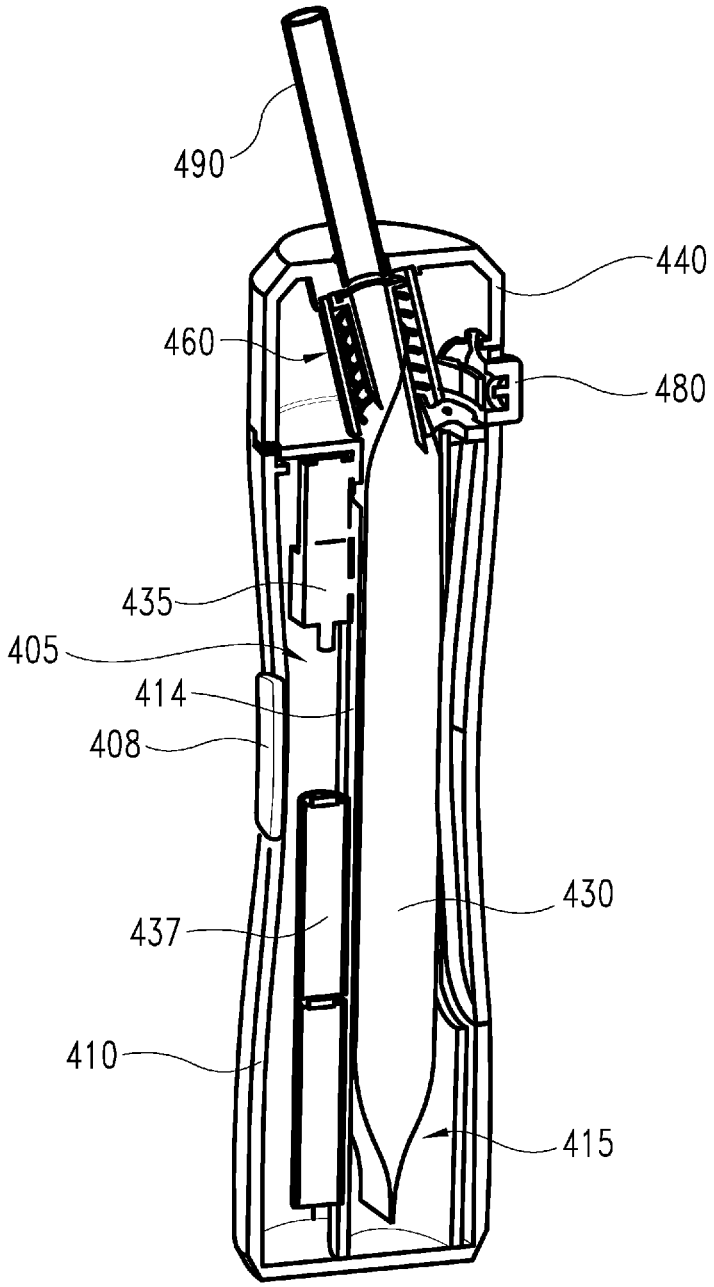
FIG. 19 is a cross-sectional view of dispenser of FIG. 17.

A cross-sectional view of the dispenser is illustrated in FIG. 19. This view shows the dispenser opening 405 within the base housing 410. A bladder compartment 414 is positioned within the dispenser opening 405. The bladder compartment 414 includes the inflatable bladder 420 and defines a tube opening 415 for receiving a flexible tube. The bladder 420 is inflatable within the bladder compartment 414 so that the bladder 420 has an uninflated configuration in which the bladder 420 takes up only a small portion of the bladder compartment 414. The bladder 220 also has an inflated configuration in which the bladder 220 expands within the bladder tube opening 415. As shown in FIG. 19, a flexible tube 430 may be positioned within tube opening 415 of the bladder compartment 414.

A motor in the form of a pump 435 is positioned within the dispenser opening 405 adjacent to the bladder compartment 414 and exterior to the tube opening 415. The pump 435 is in fluid communication with the bladder 220 and operable to allow inflation and/or deflation of the bladder 220. A power source, such as batteries 437, are also positioned within the dispenser opening 405 to provide power to operate the pump 435. In the embodiment shown, there are two batteries shown within dispenser opening 405. However, in other embodiments, fewer or more batteries are included, or different suitable types of power sources to operate the pump 435 may be included.

Figure 20:
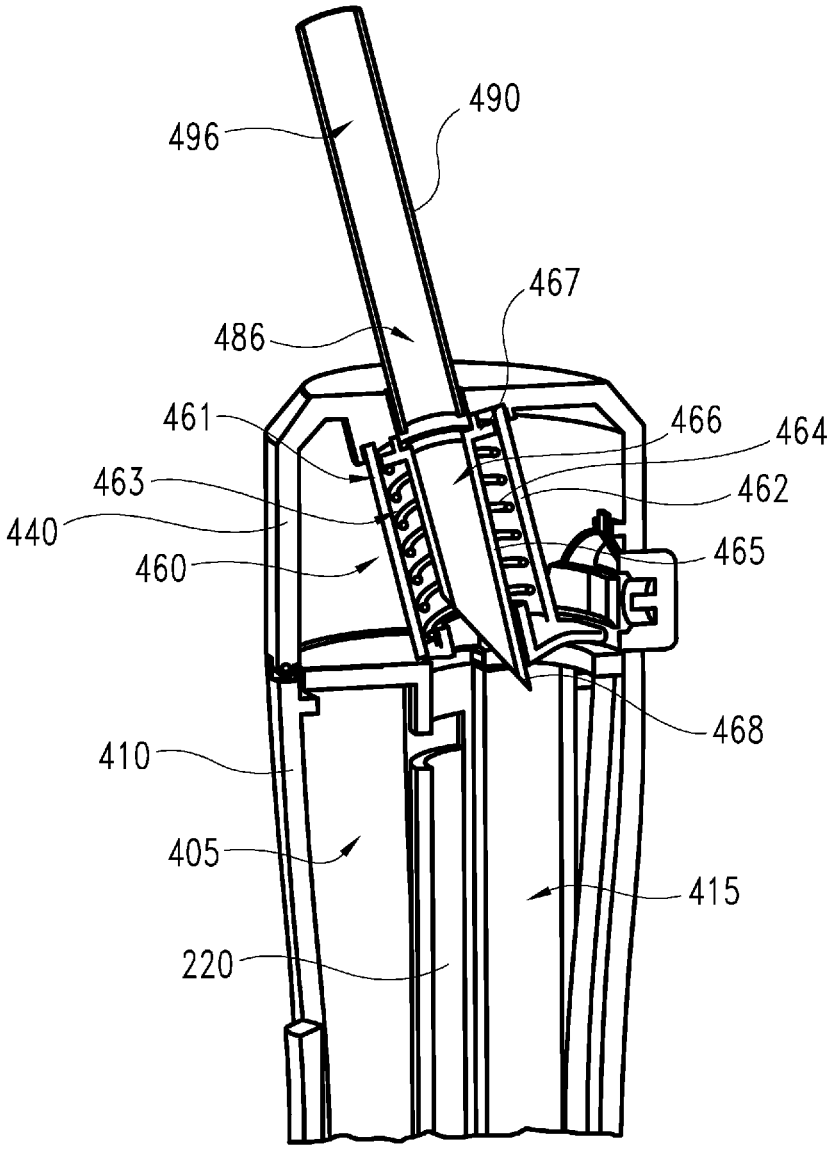
FIG. 20 is a cross-sectional view of a mouthpiece assembly of the dispenser of FIG. 17 in an undeployed position.

As shown in FIG. 19, and shown in greater detail in FIG. 20, the dispenser cap 440 includes a mouthpiece assembly 460 configured to allow a flexible tube 430 positioned within the tube opening 415 of the dispenser 400 to be punctured to allow the contents of the flexible tube 430 to be dispensed. The mouthpiece assembly 460 includes a piercer assembly 461 and the mouthpiece insert 490, which is removable from the piercer assembly 461. Additionally, the mouthpiece assembly 460 defines a mouthpiece channel 486 that is formed by a piercer tool channel 466 defined through the piercer assembly 161 and a mouthpiece insert channel 496 defined through the mouthpiece insert 490.

The piercer assembly 461 includes piercer sheath 462, which defines a piercer sheath recess 463. One end of the piercer sheath recess 463 is in communication with the mouthpiece opening 441 defined through a surface of the dispenser cap 440, and an opposite end of the piercer sheath recess 463 is in communication with the dispenser opening 405. In some embodiments, the piercer sheath recess 463 is in communication with the tube opening 415, within the dispenser opening 405, when the bladder compartment 414 is positioned withing the dispenser opening 405.

A piercer tool 465 is positioned within the piercer sheath 462. The piercer tool 465 defines the piercer tool channel 466 that extends through the piercer tool 465. The piercer tool 465 includes a piercer tool skirt 467 at one end of the piercer tool 465, and a tapered end 468 at an opposite end of the piercer tool 465. A biasing member, such as piercer spring 464, is positioned within the piercer sheath 462. The piercer spring 464 is in contact with the piercer tool skirt 467 and surrounds at least a portion of the piercer tool 465.

Figure 22:
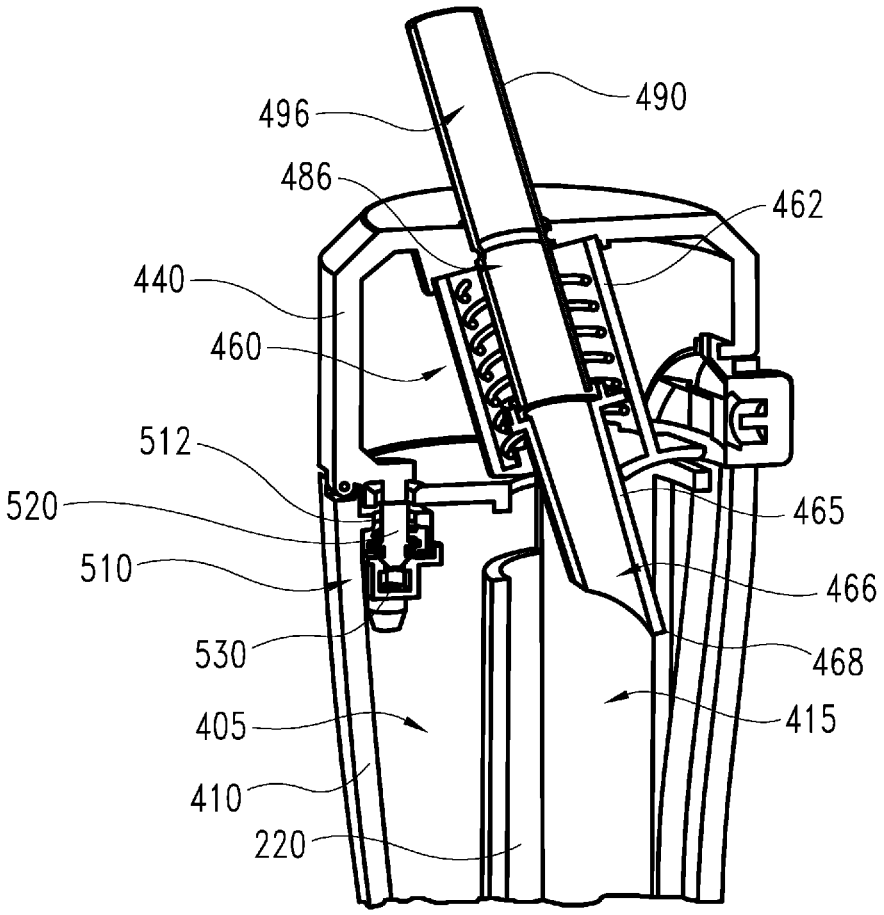
FIG. 22 is a cross-sectional view of the mouthpiece assembly of the dispenser of FIG. 17 in a deployed position and including a sealing assembly.

The piercer tool 465 may be arranged in an undeployed position (see FIG. 20) or a deployed position (see FIG. 22). In the undeployed position, as shown in FIG. 20, the tapered end 468 of the piercer tool 465 is positioned to extend only slightly through the bottom opening of the piercer sheath 462 and into the tube opening 415. The piercer tool skirt 467 is positioned near the top opening of the piercer sheath 462. The piercer spring 464 pushes on the piercer tool skirt 467 to bias the piercer tool 465 into the undeployed position.

The piercer tool 465 is moved into the deployed position by using an object, such as the mouthpiece insert 490, to apply force on the piercer tool skirt 467, pushing the piercer tool 465 toward the tube opening 415. If the force on the piercer tool skirt 467 overcomes the biasing force of the piercer spring 464, the tapered end 468 of the piercer tool 465 is pushed into the tube opening 415 to puncture a flexible tube 430 positioned within the tube opening 415. The piercer spring 464 then moves the piercer tool 465 back into the undeployed position when the force on the piercer tool skirt 467 is removed, for example by removing the mouthpiece insert 490 from the mouthpiece opening 441.

Figure 21:
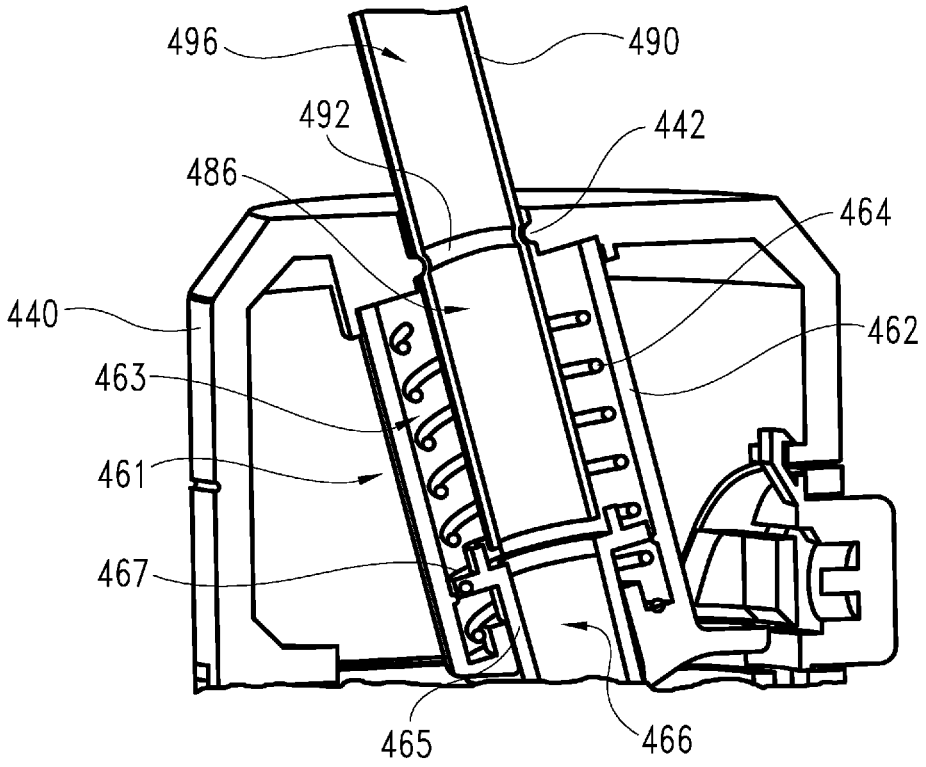
FIG. 21 is a cross-sectional view of the mouthpiece assembly of the dispenser of FIG. 17 in a deployed position.

As shown in FIG. 21, in some embodiments, the dispenser cap 440 may include a detent 442 within the mouthpiece opening 441 that may assist to retain the mouthpiece insert 490 within the mouthpiece opening 441 to allow for the piercer tool 465 to remain in the deployed position. The mouthpiece insert 490 may define a detent recess 492 that receives the detent 442 of the dispenser cap 440. However, in some embodiments, the mouthpiece insert 490 may include a detent projection that extends into a detent recess defined through the dispenser cap at the mouthpiece opening 441. In other embodiments, the detent 442 may be a removable ring that sits within the dispenser cap 440. The removable ring may extend into the detent recess 492 of the mouthpiece insert 490 to secure the mouthpiece insert 490 to the dispenser cap 440.

Figure 23:
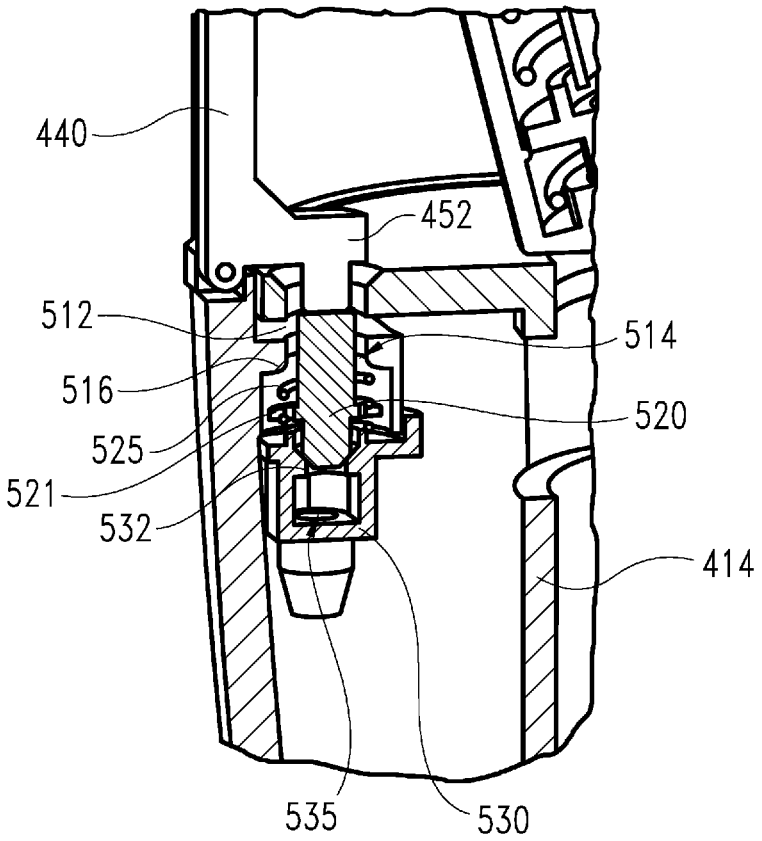
FIG. 23 is a cross-sectional view of the sealing assembly of FIG. 22 with a dispenser cap of the dispenser in a closed position.
Figure 24:
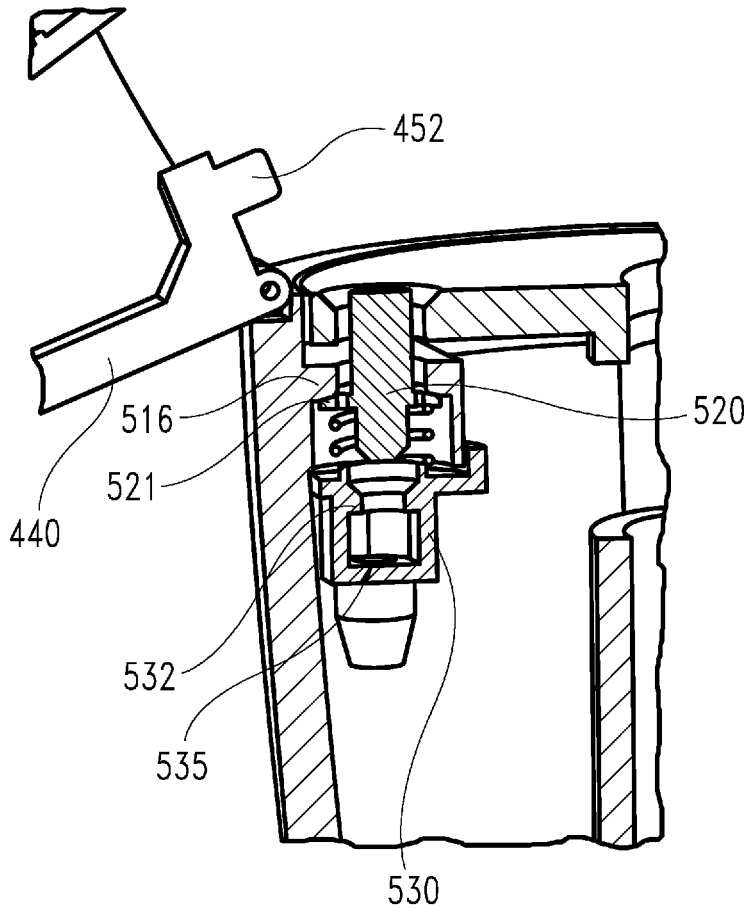
FIG. 24 is a cross-sectional view of the sealing assembly of FIG. 22 with the dispenser cap of the dispenser in an open position.

As illustrated in FIGS. 22-24, some embodiments of dispenser 400 may include a sealing mechanism 510 that allows for automatic deflation of the bladder 420 when the dispenser cap 440 is opened and hinged away from the base housing 410. The sealing mechanism 510 includes a plug housing 512 positioned within the dispenser opening 405 defined by the base housing 410. The plug housing 512 defines a plug housing opening 514 and includes sidewalls that define a plug housing overhang 516 that extends into the plug housing opening 514. A plug 520 is positioned within the plug housing opening 514 and includes a plug skirt 521 that has a diameter that is greater than diameter of the plug housing opening 514 defined at the plug housing overhang 516. A biasing member, such as a plug spring 525 at least partially surrounds the plug 520 and acts on the plug skirt 521 to bias the plug skirt 521 to be in contact with the plug housing overhang 516.

The sealing mechanism 510 also includes a nozzle 530 that includes a plug seat 532. The nozzle 530 also defines a nozzle opening 535 that is in fluid communication with the bladder 420. The plug seat 532 is shaped to correspond to the shape of the plug 520, so that the plug 520 may be fit into the plug seat 532 to prevent air from being released from the bladder 420 through the nozzle opening 535 when the plug 520 is positioned in the plug seat 532.

As shown in FIG. 23, the dispenser cap 440 includes a dispenser cap finger 452 that is in contact with the plug 520 when the dispenser cap 440 is in a closed position. The dispenser cap finger 452 pushes against the bias of the plug spring 525 and forces the plug 520 into the plug seat 532 so that the plug 520 seals the nozzle opening 535 and prevents air from escaping from the bladder 420.

As shown in FIG. 24, when a user hinges the dispenser cap 440 into an open position to remove a flexible tube 430 from the dispenser 400, the dispenser cap finger 452 no longer contacts the plug 520. The plug spring 525 biases the plug 520 toward the plug housing overhang 516 and out of the plug seat 532. With the plug 520 removed from the plug seat 532, the plug no longer seals the nozzle opening 535. With the nozzle opening 535 unsealed, air from the bladder 420 is released through the nozzle opening 535 and the bladder 420 deflates.

While embodiments of the disclosure have been illustrated and described in detail in the drawings and foregoing description, the same is to be considered as illustrative and not restrictive in character, it being understood that only some embodiments have been shown and described and that all changes and modifications that come within the spirit of the disclosures herein are desired to be protected.

While embodiments of the disclosure have been illustrated and described in detail in the drawings and foregoing description, the same is to be considered as illustrative and not restrictive in character, it being understood that only some embodiments have been shown and described and that all changes and modifications that come within the spirit of the disclosures herein are desired to be protected.

The invention claimed is:

1. A dispenser comprising:

a shell, wherein a dispenser opening is defined within an interior of said shell;

an inflatable bladder positioned within said dispenser opening;

a dispenser cap attachable to said shell, wherein said dispenser cap defines a mouthpiece opening;

a mouthpiece assembly including a tapered end and defining a mouthpiece channel extending through a length of said mouthpiece assembly, wherein said tapered end of said mouthpiece assembly is extendable into said dispenser opening; and wherein inflation of said inflatable bladder when a flexible tube is positioned within said dispenser is configured to expel contents of said flexible tube into said mouthpiece channel and through said mouthpiece channel.

2. The dispenser of claim 1, wherein said mouthpiece assembly includes a piercer assembly positioned within said dispenser cap and a mouthpiece insert that is insertable into said mouthpiece opening.

3. The dispenser of claim 2, wherein said piercer assembly includes a piercer sheath and a piercer tool positioned within a piercer sheath recess defined by said piercer sheath.

4. The dispenser of claim 3, wherein said tapered end of said mouthpiece assembly is positioned at an end of said piercer tool.

5. The dispenser of claim 3, wherein said piercer tool is configured to be moved between an undeployed position and a deployed position; and wherein a larger portion of said piercer tool is positioned within said dispenser opening when said piercer tool is in said deployed position compared to said undeployed position.

6. The dispenser of claim 5, wherein a piercer spring positioned within said piercer sheath biases said piercer tool into said undeployed position.

7. The dispenser of claim 3, wherein said piercer tool defines a piercer tool channel;

wherein said mouthpiece insert defines a mouthpiece insert channel; and wherein said mouthpiece channel is formed by said piercer tool channel and said mouthpiece insert channel when said mouthpiece insert is positioned in said mouthpiece opening.

8. The dispenser of claim 1, further comprising:

a motor, wherein said motor is operable to inflate said inflatable bladder.

9. The dispenser of claim 8, further comprising:

an inflation actuator, wherein actuation of the inflation actuator is configured to operate said motor to inflate said inflatable bladder.

10. The dispenser of claim 1, wherein said inflatable bladder or said dispenser opening has a differing thickness along a least a portion of its longest length.

11. The dispenser of claim 1, further comprising:

a sealing mechanism; and wherein said sealing mechanism is configured to deflate said inflatable bladder when said dispenser cap is in an open position, hinged away from said shell.

12. The dispenser of claim 11, wherein said sealing mechanism comprises:

a plug;

a nozzle including a plug seat;

wherein said plug seals said nozzle when said plug is positioned in said plug seat; and wherein said nozzle allows air to be removed from said inflatable bladder when said plug is removed from said plug seat.

13. The dispenser of claim 12, wherein said dispenser cap includes a dispenser cap finger that is configured to contact said plug when said dispenser cap is in a closed position to move said plug into said plug seat.

14. The dispenser of claim 13, wherein said dispenser cap finger is not in contact with said plug when said dispenser cap is in the open position, and wherein said plug is removed from said plug seat when said dispenser cap finger is not in contact with said plug.

15. A method of dispensing a product from a flexible tube, said method comprising:

inserting at least a portion of a flexible tube into a dispenser opening defined by a shell, wherein an inflatable bladder is positioned within said dispenser opening;

coupling a cap to said shell, wherein at a mouthpiece opening is defined through said cap, and wherein said mouthpiece opening is in communication with said dispenser opening when said cap is attached to said shell;

inserting at least a portion of a mouthpiece assembly through said mouthpiece opening and into said dispenser opening, wherein a bottom end of said mouthpiece assembly pierces said flexible tube;

inflating said inflatable bladder within said dispenser opening so that said inflatable bladder applies a force on said flexible tube; and wherein the force applied on said flexible tube due to inflation of said inflatable bladder causes product from within said flexible tube to be expelled from said mouthpiece assembly.

16. The method of claim 15, further comprising:

deflating said inflatable bladder.

17. The method of claim 16, further comprising:

decoupling said cap from said shell; and removing said flexible tube from said dispenser opening.

18. The method of claim 15, wherein said mouthpiece assembly includes a mouthpiece insert and a piercer assembly including a piercer tool; and wherein inserting said mouthpiece insert into said mouthpiece opening causes a tapered end of said piercer tool to extend into said dispenser opening to pierce said flexible tube.

* * * * *